US012370647B2

(12) United States Patent
Annen et al.

(10) Patent No.: US 12,370,647 B2
(45) Date of Patent: Jul. 29, 2025

(54) POROUS ABRASIVE ARTICLE

(71) Applicant: 3M INNOVATIVE PROPERTIES COMPANY, St. Paul, MN (US)

(72) Inventors: Michael J. Annen, Hudson, WI (US); Deborah J. Eilers, Hastings, MN (US); Chainika Jangu, Mountain View, CA (US); Caroline E. Morel, St. Paul, MN (US); Kathleen S. Shafer, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 990 days.

(21) Appl. No.: 16/770,647

(22) PCT Filed: Dec. 6, 2018

(86) PCT No.: PCT/IB2018/059735
§ 371 (c)(1),
(2) Date: Jun. 8, 2020

(87) PCT Pub. No.: WO2019/111212
PCT Pub. Date: Jun. 13, 2019

(65) Prior Publication Data

US 2020/0298373 A1 Sep. 24, 2020

Related U.S. Application Data

(60) Provisional application No. 62/596,277, filed on Dec. 8, 2017.

(51) Int. Cl.
*B24D 11/00* (2006.01)
*B24D 3/28* (2006.01)
(Continued)

(52) U.S. Cl.
CPC ..... *B24D 3/28* (2013.01); *B24D 11/02* (2013.01); *B24D 18/0045* (2013.01);
(Continued)

(58) Field of Classification Search
CPC ..... B24D 3/28; B24D 11/02; B24D 18/0072
(Continued)

(56) References Cited

U.S. PATENT DOCUMENTS 4,314,827 A 2/1982 Leitheiser et al.
4,623,364 A 11/1986 Cottringer et al.
(Continued)

FOREIGN PATENT DOCUMENTS

CN 103372818 10/2013
DE 102004007747 12/2004
(Continued)

OTHER PUBLICATIONS

Lee, "Handbook of Epoxy Resins", 1967, pp. 1-3.
International Search Report for PCT International Application No. PCT/IB2018/059735, mailed on Mar. 29, 2019, 5 pages.

*Primary Examiner* — James E McDonough

(57) ABSTRACT

An abrasive article comprising an attachment layer and an abrasive layer. The attachment layer comprises a porous backing having a first major surface, an opposed second major surface, and a first plurality of voids extending from the first major surface to the second major surface. The abrasive layer has a third major surface and an opposed fourth major surface and comprises a cured composition, abrasive particles at least partially embedded in the cured composition, and a second plurality of voids extending from the third major surface to the fourth major surface. The first major surface of the attachment layer is adjacent the third
(Continued)

major surface of the abrasive layer, and the pattern of the second plurality of voids is independent of the pattern of the first plurality of voids.

13 Claims, 5 Drawing Sheets

(51) Int. Cl.
*B24D 11/02* (2006.01)
*B24D 18/00* (2006.01)
*B24B 55/10* (2006.01)

(52) U.S. Cl.
CPC ..... *B24D 18/0072* (2013.01); *B24B 55/102* (2013.01); *B24B 55/105* (2013.01); *B24B 55/107* (2013.01)

(58) Field of Classification Search
USPC ..... 51/293, 295, 298
See application file for complete search history.

(56) References Cited

U.S. PATENT DOCUMENTS

| | | | |
|---|---|---|---|
| 4,652,275 | A | 3/1987 | Bloecher et al. |
| 4,744,802 | A | 5/1988 | Schwabel |
| 4,770,671 | A | 9/1988 | Monroe et al. |
| 4,799,939 | A | 1/1989 | Bloecher et al. |
| 4,848,041 | A | 7/1989 | Kruschke |
| 4,881,951 | A | 11/1989 | Wood et al. |
| 5,152,917 | A | 10/1992 | Pieper et al. |
| 5,201,916 | A | 4/1993 | Berg et al. |
| 5,213,591 | A | 5/1993 | Celikkaya et al. |
| 5,372,620 | A | 12/1994 | Rowse et al. |
| 5,435,816 | A | 7/1995 | Spurgeon et al. |
| RE35,570 | E | 7/1997 | Rowenhorst et al. |
| 5,672,097 | A | 9/1997 | Hoopman |
| 5,946,991 | A | 9/1999 | Hoopman |
| 5,975,987 | A | 11/1999 | Hoopman et al. |
| 5,984,998 | A | 11/1999 | Ottesen et al. |
| 6,129,540 | A | 10/2000 | Hoopman et al. |
| 8,034,137 | B2 | 10/2011 | Erickson et al. |
| 8,038,750 | B2 | 10/2011 | Pribyl et al. |
| 8,142,531 | B2 | 3/2012 | Adefris et al. |
| 8,142,532 | B2 | 3/2012 | Erickson et al. |
| 8,142,891 | B2 | 3/2012 | Culler et al. |
| 2002/0182955 | A1 | 12/2002 | Weglewski et al. |
| 2006/0148390 | A1* | 7/2006 | Woo ..... B24D 11/02 451/526 |
| 2007/0243803 | A1 | 10/2007 | Oka et al. |
| 2009/0165394 | A1 | 7/2009 | Culler et al. |
| 2009/0169816 | A1 | 7/2009 | Erickson et al. |
| 2012/0227333 | A1 | 9/2012 | Adefris et al. |
| 2013/0040537 | A1 | 2/2013 | Schwabel et al. |
| 2013/0125477 | A1 | 5/2013 | Adefris |
| 2013/0344786 | A1 | 12/2013 | Keipert |
| 2015/0267097 | A1 | 9/2015 | Rosenflanz et al. |
| 2015/0343605 | A1 | 12/2015 | Höglund et al. |

FOREIGN PATENT DOCUMENTS

| | | |
|---|---|---|
| EP | 1177861 | 2/2002 |
| EP | 1838497 | 10/2007 |
| GB | 2515764 A | 1/2015 |
| JP | S63144968 | 6/1988 |
| WO | WO 2006/074058 | 7/2006 |
| WO | WO 2006-113143 | 10/2006 |
| WO | 2007019114 A2 | 2/2007 |
| WO | WO 2016-160357 | 10/2016 |

* cited by examiner

POROUS ABRASIVE ARTICLE

BACKGROUND

It is very common for dry sanding operations to generate a significant amount of airborne dust. To minimize this airborne dust, it is common to use abrasive discs on a tool while vacuum is drawn through the abrasive disc, from the abrasive side through the backside of the disc, and into a dust-collection system. For this purpose, many abrasives are available with holes converted into them, to facilitate this dust extraction. As an alternative to converting dust-extraction holes into abrasive discs, commercial products exist in which the abrasive is coated onto fibers of a net-type knit backing in which loops are knit into the backside of the abrasive article. The loops serve as the loop-portion of a hook-and-loop attachment system for attachment to a tool. Coating abrasive only onto the fibers of net-type backing results in a very low percentage of abrasive area on an abrasive disc. Consequently, the abrasive performance (cut and/or life) of this type of abrasive is low compared to that of a conventional abrasive with dust-extraction holes. Net type products are known to provide superior dust extraction and/or anti-loading properties, when used with substrates known to severely load traditional abrasives. However, cut and/or life performance are still lacking. Thus, there is a need for a net type product that provides enhanced cut and/or life performance while demonstrating superior dust extraction.

DESCRIPTION OF THE FIGURES

The drawings illustrate generally, by way of example, but not by way of limitation, various embodiments discussed in the present document.

It should be understood that numerous other modifications and examples can be devised by those skilled in the art, which fall within the scope and spirit of the principles of the disclosure. Figures may not be drawn to scale.

DESCRIPTION

Embodiments described herein are directed to an abrasive article that not only retains the dust-extraction advantages of an abrasive on a net-type backing, but also demonstrates abrasive performance (cut and/or life) advantages of a conventional abrasive. This combination of benefits (dust extraction and cut and/or life) is possible because the abrasive is pattern-coated, forming well-defined areas of abrasive coating as well as open areas devoid of any abrasive coating. Since the abrasive coating is not only on the fibers of a knit backing, the patterned abrasive area can be designed independent of the net-type knit backing, to optimize both abrasive performance and dust extraction.

Figure 1:
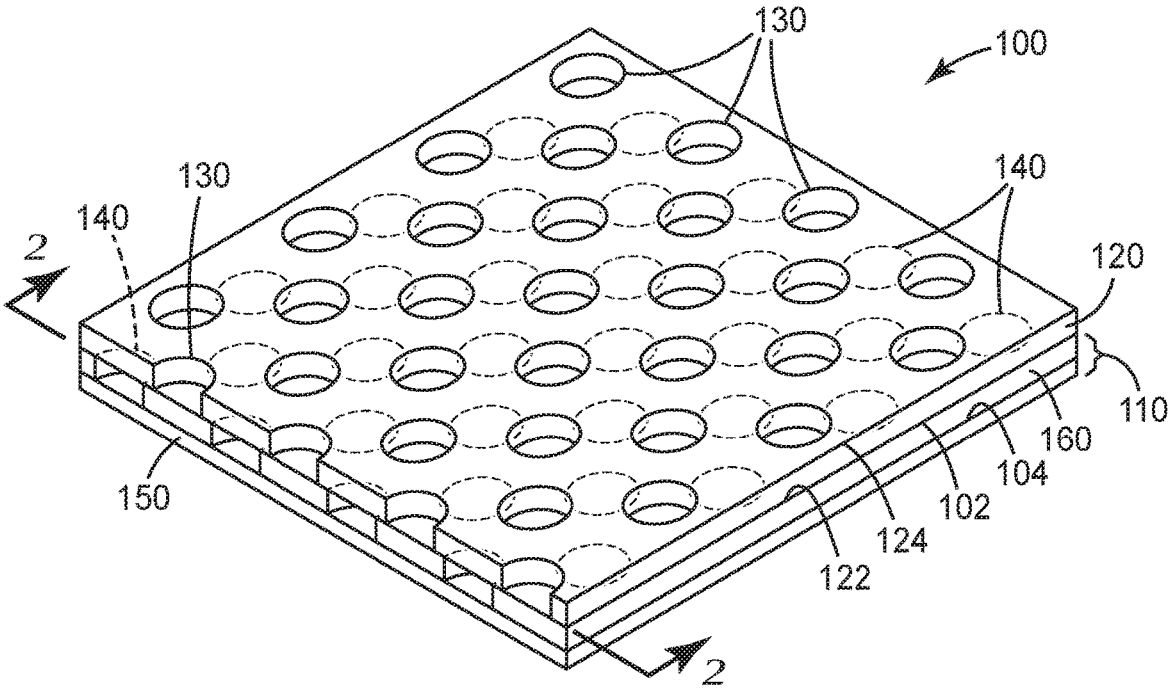
FIG. 1 is a perspective view of abrasive articles according to various embodiments of the present disclosure.

Referring to FIG. 1, embodiments of abrasive articles of the present disclosure include an abrasive article referred to by the numeral 100. Abrasive article 100 includes an attachment layer 110, further comprising porous backing layer 160 having first major surface 102 and an opposed second major surface 104; and an abrasive layer 120, having a third major surface 122 and an opposed fourth major surface 124. Porous backing layer 160 includes a first plurality of voids 140 (phantom lines) forming a first pattern and extending from the first major surface 102 to the second major surface 104 of porous backing layer 160. In some embodiments, attachment layer 110 may include one part of a two-part interconnecting attachment mechanism. The two-part interconnecting attachment mechanism may be a hook-and-loop two-part interconnecting attachment mechanism. In some embodiments, the one part of a two-part interconnecting attachment mechanism may be the hook portion of a hook-and-loop two-part interconnecting attachment mechanism. In some embodiments, the one part of a two-part interconnecting attachment mechanism may be the loop portion of a hook-and-loop two-part interconnecting attachment mechanism. In some embodiments, porous backing layer 160 of attachment layer 110 may include one part of a two-part interconnecting attachment mechanism, i.e. one part of a two-part interconnecting attachment mechanism is integral to porous backing layer 160, e.g. the loop portion of a hook-and-loop two-part interconnecting attachment mechanism. Optionally, attachment layer 110 may include one part of a two-part interconnecting attachment mechanism layer 150. Optional one part of a two-part interconnecting attachment mechanism layer 150 may be positioned adjacent second major surface 104 of porous backing layer 160. Abrasive layer 120 includes a cured composition and abrasive particles at least partially embedded in the cured composition; and a second plurality of voids 130, absent of the cured composition, extending from the third major surface 122 to the fourth major surface 124 and forming a second pattern, the second pattern being independent of the first pattern. The first major surface 102 of porous backing layer 160 is adjacent the third major surface 122 of the abrasive layer. In some embodiments, abrasive layer 120 is a continuous abrasive layer. In some embodiments, abrasive layer 120 is a continuous abrasive layer and optional one part of a two-part interconnecting attachment mechanism layer 150 is not employed.

In some examples, the abrasive article of the various embodiments described herein exhibit an air flow through the article at a rate of at least about 1.0 L/s, 1.5 L/s, 2.0 L/s, 2.5 or even 3.0 L/s, such that, when in use, dust can be removed from an abraded surface through the abrasive article.

Figure 4A:
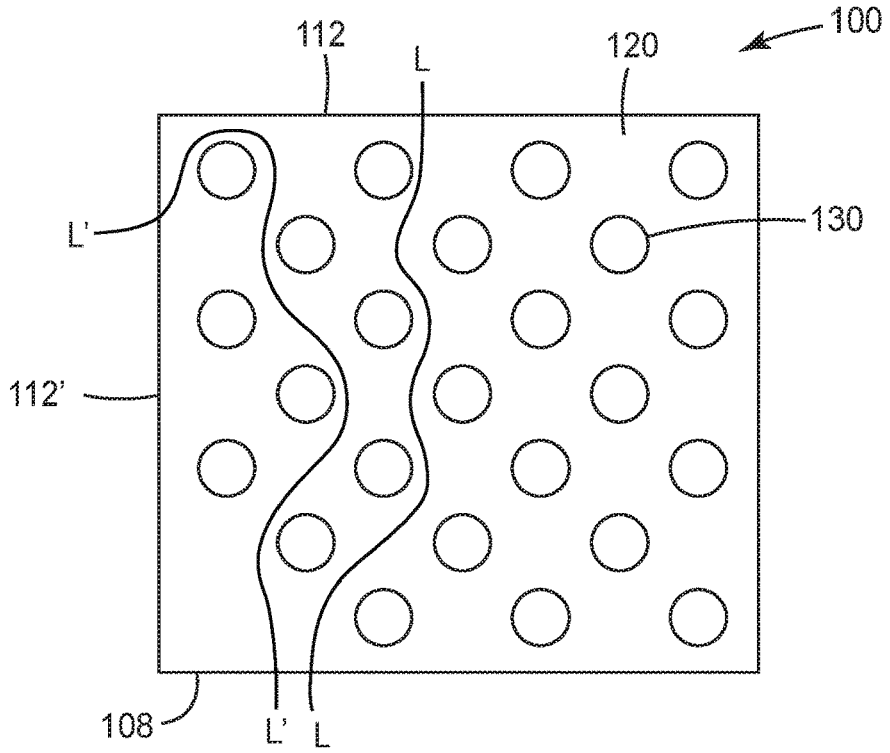
FIGS. 4A and 4B are top views of abrasive articles according to various embodiments of the present disclosure.
Figure 4B:
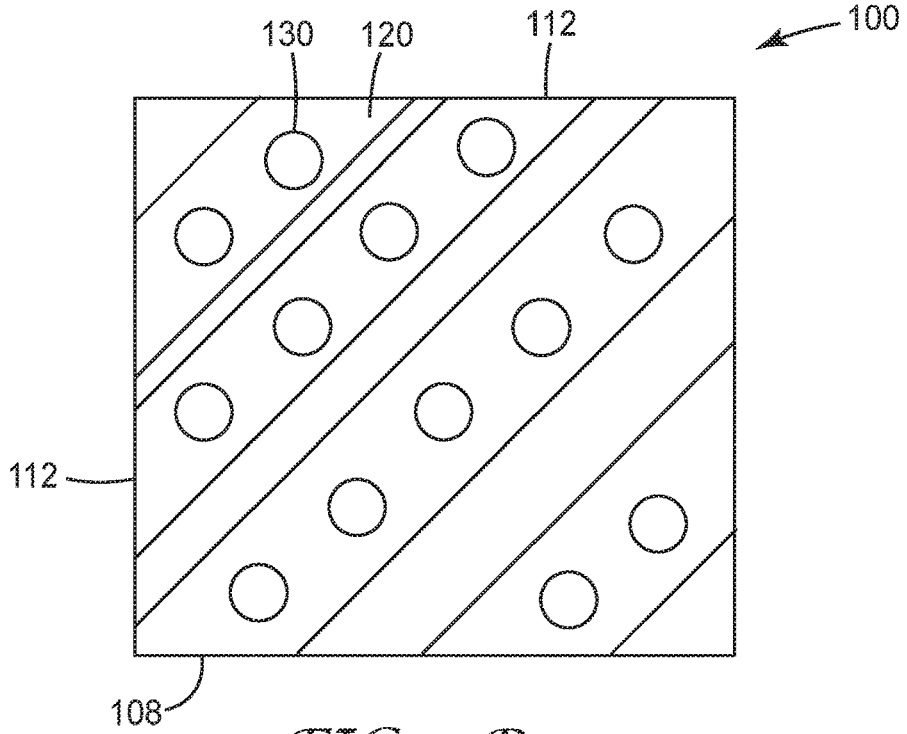

As used herein, the term "continuous" in the context of continuous abrasive layer 120 generally means that a line, for examples lines L and L', can be traced from an edge 108 to another edge 112 and an edge 108 and 112' of the abrasive layer 120 as shown in FIG. 4A. In other words, the abrasive layer 120 is not interrupted as shown in FIG. 4B, in the form of stripes.

Figure 2:
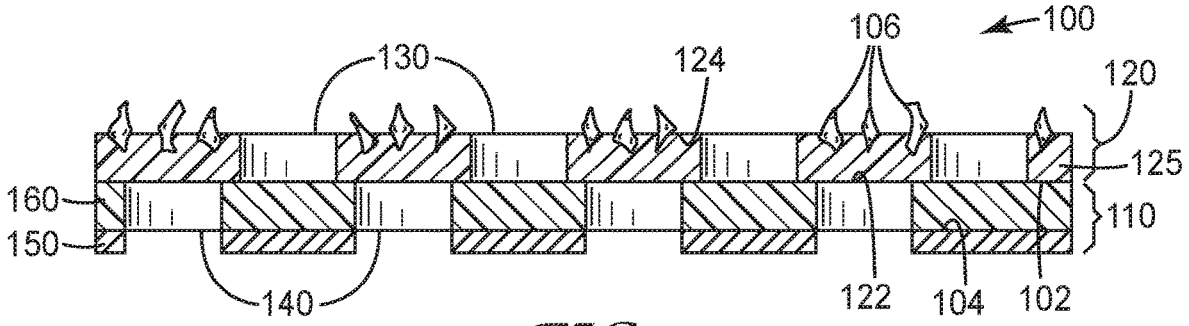
FIG. 2 is a side cross-sectional view of an abrasive article according to various embodiments of the present disclosure.

FIG. 2 shows a section of the abrasive article referred to by the numeral 100 taken on the line 2-2 of FIG. 1 looking in the direction of the arrows. As shown in FIG. 2, abrasive article 100 includes: an attachment layer 110, including porous backing layer 160 which includes porous backing layer 160 having first major surface 102 and an opposed second major surface 104. Porous backing layer 160 includes a first plurality of voids 140 forming a first pattern and extending from the first major surface 102 to the second major surface 104 of porous backing layer 160. In some embodiments, porous backing layer 160 may be one part of a two-part interconnecting attachment mechanism, i.e. one part of a two-part interconnecting attachment mechanism is integral to porous backing layer 160. Optionally, attachment layer 110 may include one part of a two-part interconnecting attachment mechanism layer 150. Optional one part of a two-part interconnecting attachment mechanism layer 150 may be positioned adjacent second major surface 104 of porous backing layer 160. Abrasive article 100 further includes an abrasive layer 120 (e.g., a continuous abrasive layer), having a third major surface 122 and an opposed fourth major surface 124, comprising: a cured composition 125 and abrasive particles 106 at least partially embedded in the cured composition; and a second plurality of voids 130, absent of the cured composition, extending from the third major surface 122 to the fourth major surface 124 and forming a second pattern, the second pattern being independent of the first pattern, and wherein first major surface 102 of the porous backing layer 160 is adjacent the third major surface 122 of the abrasive layer.

Figure 3A:
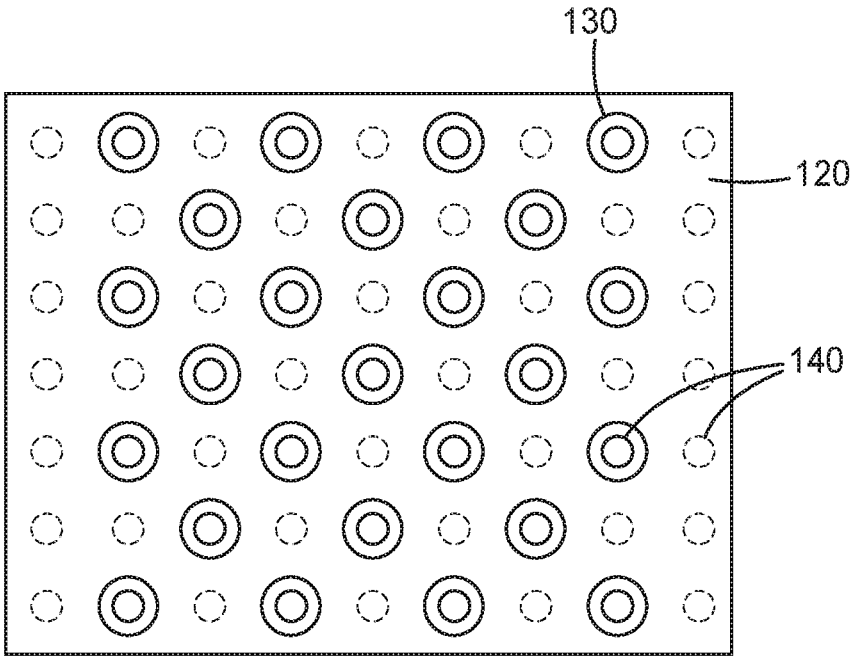
FIGS. 3A and 3B are top views of abrasive articles according to various embodiments of the present disclosure.
Figure 3B:
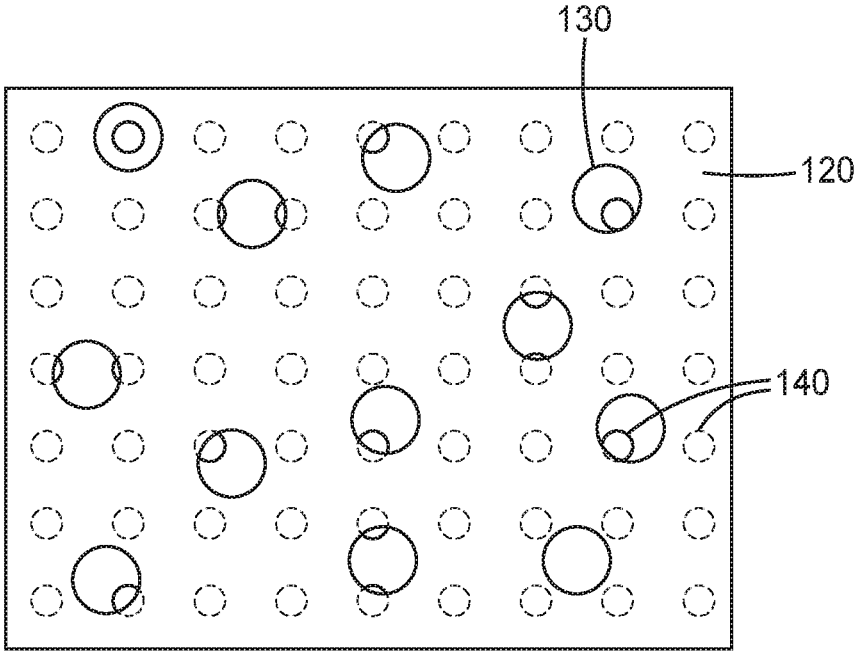

In some embodiments, at least one of the plurality of voids 130 and plurality of voids 140 forms a regular pattern. FIG. 3A is a depiction of a regular pattern of voids 130 that can be formed in the abrasive layer 120 and a regular pattern of voids 140 that can be formed in the attachment layer 110, whereas FIG. 3B is a depiction of an irregular pattern of voids 130 that can be formed in the abrasive layer 120 and a regular pattern of voids 140 that can be formed in the attachment layer 110. In some embodiments, both the plurality of voids 130 and plurality of voids 140 forms an irregular pattern.

Although FIGS. 1, 3A, and 3B depict the voids 130 and 140 as having a substantially circular shape and voids 130 generally being larger than voids 140, the voids can have any suitable shape (e.g., oblong, square, triangular, rhomboid, and the like) and can be of any suitable size. In addition, not all voids 130 completely overlap with voids 140. As shown in FIGS. 2, 3A, and 3B, in some embodiments, voids 130 can completely overlap with voids 140, but not all voids 130 need overlap with voids 140. As those of skill in the art will appreciate, however, a larger percentage of overlap between voids 130 and voids 140 will likely lead to dust-extraction advantages for the abrasive articles described herein.

In some embodiments, abrasive layer 120 covers no greater than about 40%, no greater than about 50%, no greater than about 60%, no greater than about 70%, no greater than about 80%, no greater than about 90%, no greater than 95% or even no greater than about 98% of the first major surface 102 of the attachment layer 110. In some embodiments, abrasive layer 120 covers from about 50% to about 98%, from about 50% to about 95%, from about 50% to about 90%, from about 50% to about 85%, from about 50% to about 80%, from about 60% to about 98%, from about 60% to about 95%, from about 60% to about 90%, from about 60% to about 85%, from about 60% to about 80%, from about 70% to about 98%, from about 70% to about 95%, from about 70% to about 90%, from about 70% to about 85% or even from about 70% to about 80% of the first major surface 102 of the attachment layer 110. In some instances, this means that although edges of the abrasive layer 120 substantially overlap with edges of the attachment layer 110, as shown in FIG. 1, for example, the area of voids 130 is such that the third major surface 122 of the abrasive layer 120 covers no greater than 98% of the first major surface 102 of the attachment layer 110.

Figure 5:
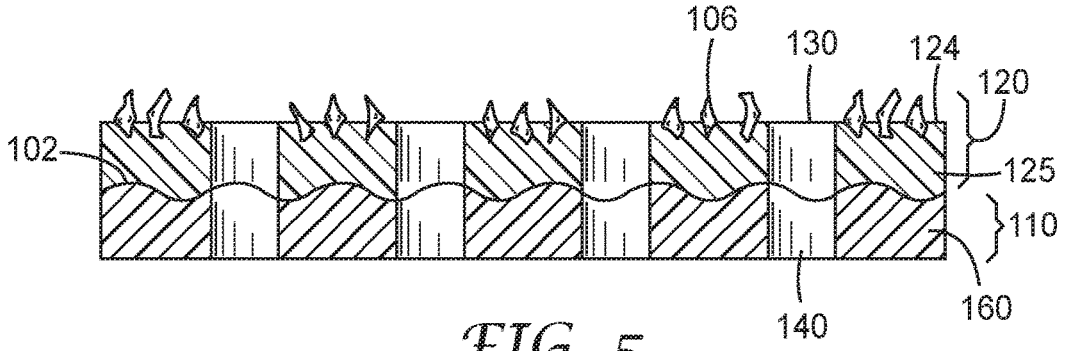
FIG. 5 is a side cross-sectional view of an abrasive article according to various embodiments of the present disclosure.

In some embodiments, the surface topography of the fourth major surface 124, comprising abrasive particles 106, is independent of a topography of the first major surface 102 of the attachment layer 110. In other words, even if a topography of the first major surface 102 of the attachment layer 110 is "wavy," as shown in FIG. 5, the surface topography of the fourth major surface 124 can be substantially flat and need not/does not follow the wavy topography of the first major surface 102 of the attachment layer 110.

As used herein, the term "at least partially embedded" generally means that at least a portion of an abrasive particle is embedded in the cured composition, such that, the abrasive particle is anchored in the cured composition.

Figure 6:
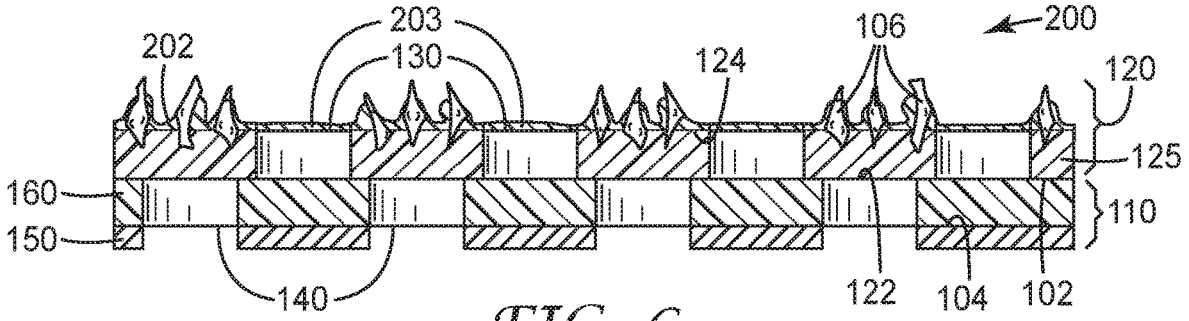
FIGS. 6 and 7 are side cross-sectional views of abrasive articles according to various embodiments of the present disclosure.

FIG. 6 shows one example of an abrasive article referred to by the numeral 200, which incorporates all of the features shown in FIG. 2, which will not be discussed again for the sake of brevity, but also a size coat 202 having size coat void spaces 203.

Figure 7:
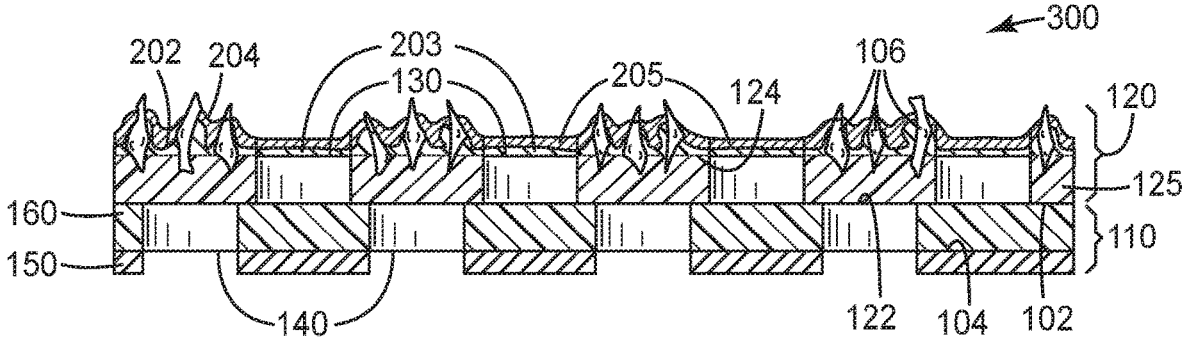

In some embodiments, the abrasive article of the various embodiments described herein can have a supersize coat in addition to the size coat 202. FIG. 7 shows an abrasive article referred to by the numeral 300, which incorporates all of the features shown in FIG. 2, which will not be discussed again for the sake of brevity, but also a size coat 202 having size coat void spaces 203 and a supersize coat 204 having supersize coat void spaces 205.

Optionally but not shown, one or more additional layers could be disposed between any of the layers described herein to help adhere layers to each other, provide a printed image, act as a barrier layer, or serve any other purpose known in the art. But the layer configurations described herein are not intended to be exhaustive, and it is to be understood that layers can be added or removed with respect to any of the examples depicted in FIGS. 1-7.

The abrasive layer of the abrasive article of the various embodiments described herein includes a curable composition. Upon curing, the curable composition is referred to as a cured composition. In some embodiments, the cured composition comprises at least one of a cured epoxy-acrylate resin composition and a cured phenolic resin composition.

In some embodiments, the curable composition comprises a phenolic resin composition. Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Examples of acidic catalysts suitable for curing phenolic resins to make the cured phenolic resin composition comprised in the abrasive layer include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, or sodium carbonate.

Phenolic resins are well-known and readily available from commercial sources. Examples of commercially available novolac resins include DUREZ 1364, a two-step, powdered phenolic resin (marketed by Durez Corporation of Addison, Tex. under the trade designation VARCUM (e.g., 29302), or HEXION AD5534 RESIN (marketed by Hexion Specialty Chemicals, Inc., Louisville, Ky.). Examples of commercially available resole phenolic resins useful in practice of the present disclosure include those marketed by Durez Corporation of Addison, Tex. under the trade designation VARCUM (e.g., 29217, 29306, 29318, 29338, 29353); those marketed by Ashland Chemical Co. of Bartow, Fla. under the trade designation AEROFENE (e.g., AEROFENE 295); and those marketed by Kangnam Chemical Company Ltd. of Seoul, South Korea under the trade designation "PHENOLITE" (e.g., PHENOLITE TD-2207).

In other embodiments, the curable composition comprises a polymerizable epoxy-acrylate resin composition. In some embodiments, the polymerizable epoxy-acrylate resin composition has a complex viscosity at 125° C. and 1 Hz frequency of about 10 Pa-s to about 10,000 Pa-s; and abrasive particles at least partially embedded in the polymerizable epoxy-acrylate resin composition. In some specific examples, the cured composition/abrasive layer is the photopolymerization product of the curable composition. In some examples, the cured polymerizable epoxy-acrylate resin composition has a storage modulus (G') at 25° C. and 1 Hz frequency of at least about 300 MPa. And, in some instances, in addition to the complex viscosity at 125° C. and 1 Hz frequency of about 10 Pa-s to about 10,000 Pa-s, the curable composition also has a complex viscosity at 25° C. and 1 Hz frequency of about 1,000 Pa-s to about 100,000 Pa-s.

In some embodiments, the curable composition has a complex viscosity at 125° C. and 1 Hz frequency of at least about 10 Pa-s, at least about 50 Pa-s, at least about 100 Pa-s, at least about 1,000 Pa-s, at least about 2,000 Pa-s, at least about 3,000 Pa-s, at least about 5,000 Pa-s, or at least about 6,000 Pa-s. In some examples, the polymerizable epoxy-acrylate resin composition has a complex viscosity at 125° C. and 1 Hz frequency of up to about 1,000 Pa-s, up to about 2,000 Pa-s, up to about 3,000 Pa-s, up to about 5,000 Pa-s, up to about 6,000 Pa-s, up to about 8,000 Pa-s or up to about 10,000 Pa-s. In still other examples, the polymerizable epoxy-acrylate resin composition has a complex viscosity 125° C. and 1 Hz frequency of about 10 Pa-s to about 10,000 Pa-s, about 1000 Pa-s to about 8000 Pa-s, about 2000 Pa-s to about 5,000 Pa-s, about 500 Pa-s to about 3,000 Pa-s, about 2,000 Pa-s to about 7000 Pa-s or about 3,000 Pa-s to about 10,000 Pa-s.

In some examples, the polymerizable epoxy-acrylate resin composition also has a complex viscosity at 25° C. and 1 Hz frequency of at least about 1000 Pa-s, at least about 4000 Pa-s, at least about 8000 Pa-s, at least about 10,000 Pa-s, at least about 12,000 Pa-s, at least about 20,000 Pa-s, at least about 50,000 Pa-s, or at least about 80,000 Pa-s. In some examples, the polymerizable epoxy-acrylate resin composition has a complex viscosity at 25° C. and 1 Hz frequency of up to about 100,000 Pa-s, up to about 10,000 Pa-s, up to about 12,000 Pa-s, up to about 15,000 Pa-s, up to about 30,000 Pa-s, up to about 50,000 Pa-s or up to about 80,000 Pa-s. In still other examples, the polymerizable epoxy-acrylate resin composition has a complex viscosity 25° C. and 1 Hz frequency of about 1000 Pa-s to about 100,000 Pa-s, about 1000 Pa-s to about 8000 Pa-s, about 6000 Pa-s to about 15,000 Pa-s, about 8000 Pa-s to about 30,000 Pa-s, about 20,000 Pa-s to about 80,000 Pa-s or about 30,000 Pa-s to about 60,000 Pa-s.

In some examples, the polymerizable epoxy-acrylate resin composition has a storage modulus (G') at 25° C. and 1 Hz frequency of at least about 5,000 Pa, at least about 20,000 Pa, at least about 30,000 Pa or at least 40,000 Pa. In some examples, the polymerizable epoxy-acrylate resin composition has a G' at 25° C. and 1 Hz frequency of up to about 20,000 Pa, up to about 30,000 Pa, up to about 40,000 Pa or up to about 50,000 Pa. In still other examples, the polymerizable epoxy-acrylate resin composition has a G' at 25° C. and 1 Hz frequency of about 5000 Pa to about 10,000 Pa, 10,000 Pa to about 50,000 Pa, about 20,000 Pa to about 40,000 Pa, about 25,000 Pa to about 40,000 Pa or about 25,000 Pa to about 35,000 Pa.

In some examples, the polymerizable epoxy-acrylate resin composition has a loss modulus (G") at 25° C. and 1 Hz frequency of at least about 5,000 Pa, at least about 20,000 Pa, at least about 30,000 Pa or at least 40,000 Pa. In some examples, the curable composition has a G" at 25° C. and 1 Hz frequency of up to about 20,000 Pa, up to about 30,000 Pa, up to about 40,000 Pa or up to about 50,000 Pa. In still other examples, the curable composition has a G" at 25° C. and 1 Hz frequency of about 5000 Pa to about 10,000 Pa, 10,000 Pa to about 50,000 Pa, about 20,000 Pa to about 40,000 Pa, about 25,000 Pa to about 40,000 Pa or about 25,000 Pa to about 35,000 Pa.

In some examples, a 10 cm×5 cm×0.07 mm film (the film can be of any suitable dimension, however) formed from curing the polymerizable epoxy-acrylate resin composition has a G' at 25° C. and 1 Hz frequency of at least about 300 MPa, at least about 400 MPa, at least about 600 MPa or at least about 800 MPa. In some examples, the cured polymerizable epoxy-acrylate resin composition has a G' of up to about 400 MPa, up to about 500 MPa, or up to about 950 MPa. In some examples, a 10 cm×5 cm×0.07 mm film (the film can be of any suitable dimension, however) formed from the cured polymerizable epoxy-acrylate resin composition has a G' of about 300 MPa to about 950 MPa; about 400 MPa to about 800 MPa; or about 300 MPa to about 600 MPa.

In some examples, a 10 cm×5 cm×0.07 mm film (the film can be of any suitable dimension, however) formed from curing the polymerizable epoxy-acrylate resin composition has a G" at 25° C. and 1 Hz frequency of at least about 100 MPa, at least about 200 MPa, at least about 250 MPa or at least about 350 MPa. In some examples, the cured polymerizable epoxy-acrylate resin composition has a G" of up to about 200 MPa, up to about 300 MPa, or up to about 400 MPa. In some examples, a 10 cm×5 cm×0.07 mm film (the film can be of any suitable dimension, however) formed from the cured polymerizable epoxy-acrylate resin composition has a G" of about 100 MPa to about 300 MPa; about 100 MPa to about 200 MPa; or about 150 MPa to about 250 MPa.

The complex viscosity, G', and G" measurements can be obtained using a TA Instruments Discovery HR-2 rheometer with disposable 8 mm diameter aluminum parallel plate geometry directly probed viscoelastic properties of the polymers and generated time-temperature-superposition (TTS) curves. Measurements can be performed at a constant nominal strain value within the linear viscoelastic regime, determined with strain sweeps (0.004 to 2.0% oscillatory strain) at 1 Hz. The samples were subjected to temperature-step, frequency-sweep experiments at 10° C./step. The time-temperature superposition method can be utilized to investigate the frequency dependence over a wide frequency range. The resulting G' and G" for each polymer can be shifted using the TA Instruments TRIOS software package and horizontal shift factors (aT). Master curves based on shifting and overlapping both G' and G" generated horizontal shift factors, which can be fitted to the WLF equation using TRIOS. The G' and G" and complex viscosity values can then be extracted at 25° C. at 1 Hz frequency.

In some embodiments, films (e.g., a 38 mm×50 mm×0.50 or 0.70 mm film, but the film can be of any suitable dimension, however) formed from curing the polymerizable epoxy-acrylate resin composition, having a plurality of voids free of the polymerizable epoxy-acrylate resin composition, have a stiffness of from about 0.01 to about 0.5 N-mm (e.g., about 0.01 to about 0.1 N-mm, about 0.05 to about 0.1 N-mm or about 0.05 to about 0.09 N-mm).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a stiffness as determined using the methods described herein of no more than about 0.5 N-mm, no more than about 0.3 N-mm, no more than about 0.2 N-mm, no more than about 0.1 N-mm or no more than about 0.09 N-mm. In some examples, the cured polymerizable epoxy-acrylate resin composition, having a plurality of voids free of the polymerized epoxy-acrylate resin composition, has a stiffness of at least about 0.01 N-mm, at least about 0.05 N-mm, at least about 0.09 N-mm; at least about 0.1 N-mm or at least about 0.2 N-mm. In some examples, the cured polymerizable epoxy-acrylate resin composition, having a plurality of voids free of the polymerized epoxy-acrylate resin composition, has a stiffness of from about 0.01 to about 0.5 N-mm (e.g., about 0.01 to about 0.1 N-mm, about 0.05 to about 0.1 N-mm or about 0.05 to about 0.09 N-mm).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a bending force as determined using the methods described herein of no more than about 1.5 N, no more than about 0.7 N, no more than about 0.5 N, no more than about 0.3 N or no more than about 0.1 N. In some examples, the cured polymerizable epoxy-acrylate resin composition, having a plurality of voids free of the polymerized epoxy-acrylate resin composition, has a bending force of at least about 0.2 N, at least about 0.5 N, at least about 0.7 N; at least about 0.9 N or at least about 1.0 N. In some examples, the cured polymerizable epoxy-acrylate resin composition, having a plurality of voids free of the polymerized epoxy-acrylate resin composition, has a bending force of from about 0.1 to about 1.5 N (e.g., about 0.2 to about 0.9 N, about 0.3 to about 0.5 N or about 0.4 to about 0.9 N).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a force after holding time as determined using the methods described herein of no more than about 1.5 N, no more than about 0.7 N, no more than about 0.5 N, no more than about 0.3 N or no more than about 0.1 N. In some examples, the cured polymerizable epoxy-acrylate resin composition, having a plurality of voids free of the polymerized epoxy-acrylate resin composition, has a force after holding time of at least about 0.2 N, at least about 0.5 N, at least about 0.7 N; at least about 0.9 N or at least about 1.0 N. In some examples, the cured polymerizable epoxy-acrylate resin composition, having a plurality of voids free of the polymerized epoxy-acrylate resin composition, has a force after holding time of from about 0.1 to about 1.5 N (e.g., about 0.2 to about 0.9 N, about 0.3 to about 0.5 N or about 0.4 to about 0.9 N).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a maximum force as determined using the methods described herein of no more than about 1.5 N, no more than about 0.7 N, no more than about 0.5 N, no more than about 0.3 N or no more than about 0.1 N. In some examples, the cured polymerizable epoxy-acrylate resin composition, having a plurality of voids free of the polymerized epoxy-acrylate resin composition, has a maximum force of at least about 0.2 N, at least about 0.5 N, at least about 0.7 N; at least about 0.9 N or at least about 1.0 N. In some examples, the cured polymerizable epoxy-acrylate resin composition, having a plurality of voids free of the polymerized epoxy-acrylate resin composition, has a maximum force of from about 0.1 to about 1.5 N (e.g., about 0.2 to about 0.9 N, about 0.3 to about 0.5 N or about 0.4 to about 0.9 N).

Useful components in the curable composition used to prepare the cured composition comprised in the abrasive layer are enumerated and described in greater detail herein. In some examples, the curable composition of the various embodiments described herein comprises: i) from about 15 to about 50 parts by weight of the THF (meth)acrylate copolymer component; ii) from about 25 to about 50 parts by weight of the one or more epoxy resins; iii) from about 5 to about 15 parts by weight of the one or more hydroxy-functional polyethers; iv) in the range of from about 10 to about 25 parts by weight of at least one polyhydroxyl-containing compound; where the sum of i) to iv) is 100 parts by weight; and v) from about 0.1 to about 5 parts by weight of a photoinitiator, relative to the 100 parts of i) to iv).

In some embodiments, the polymerizable epoxy-acrylate resin component included in the curable composition comprises a tetrahydrofurfuryl (THF) (meth)acrylate copolymer component; one or more epoxy resins; and one or more hydroxy-functional polyethers.

The tetrahydrofurfuryl (THF) (meth)acrylate copolymer component is formed from a polymerizable mixture. Unless otherwise specified, THF acrylates and methacrylates will be abbreviated as THFA. More specifically, the curable composition comprises a THFA copolymer component formed from a polymerizable composition comprising one or more tetrahydrofurfuryl (meth)acrylate monomers, one or more $C_1$-$C_8$ (meth)acrylate ester monomers, one or more optional cationically reactive functional (meth)acrylate monomers, one or more chain transfer agents, and one or more photoinitiators.

The THFA copolymer component comprises a $C_1$-$C_8$ alkyl (meth)acrylate ester monomer. Useful monomers include the acrylates and methacrylate of methyl, ethyl, propyl, isopropyl, butyl, pentyl, hexyl, heptyl and octyl alcohols, including all isomers, and mixtures thereof. In some embodiments, the alcohol is selected from $C_3$-$C_6$ alkanols, and in certain embodiments, the carbon number molar average of the alkanols is $C_3$-$C_6$. It has been found that within this range the copolymer has sufficient miscibility with the epoxy resin component described herein.

In addition, the THFA copolymer component may contain a cationically reactive monomer (e.g., a (meth)acrylate monomer having a cationically reactive functional group). Examples of such monomers include, for example, glycidyl acrylate, glycidyl methacrylate, hydroxyethyl acrylate, hydroxyethyl methacrylate, hydroxypropyl methylacrylate, hydroxybutyl acrylate and alkoxysilylalkyl (meth)acrylates, such as trimethoxysilylpropyl acrylate.

In some embodiments, the copolymer is formed from a polymerizable mixture comprising one or more chain transfer agents that function to, among other things, control the molecular weight of the resultant THFA copolymer component. Examples of useful chain transfer agents include, but are not limited to, carbon tetrabromide, alcohols, mercaptans such as isooctylthioglycolate, and mixtures thereof. If used, the polymerizable mixture may include up to 0.5 weight of a chain transfer agent based on a total weight of polymerizable material. For example, the polymerizable mixture can contain 0.01 to 0.5 weight percent, 0.05 to 0.5 weight percent, or 0.05 to 0.2 weight percent chain transfer agent.

In some embodiments, the THFA copolymer component contains essentially no acid functional monomers, whose presence could initiate polymerization of the epoxy resin prior to UV curing of the curable composition. In some embodiments, the copolymer also does not contain any amine-functional monomers. Furthermore, in some embodiments, the copolymer does not contain any acrylic monomers having moieties sufficiently basic so as to inhibit cationic cure of a curable composition.

The THFA copolymer generally comprises polymerized monomer units of: (A) 40-60 wt % (e.g., 50-60 wt % and 45-55 wt %) of tetrahydrofurfuryl (meth)acrylate; (B) 40-60 wt % (e.g., 40-50 wt % and 45-55 wt %) of $C_1$-$C_8$ (e.g., $C_3$-$C_6$) alkyl (meth)acrylate ester monomers; and (C) 0-10 wt % (e.g., 1-5 wt %, 0-5 wt %, and 0-2 wt %) of cationically reactive functional monomers, wherein the sum of A)-C) is 100 wt %.

The curable compositions of the various embodiments described herein can comprise one or more THFA copolymers in various amounts, depending on the desired properties of the abrasive layer (cured and/or uncured). In some embodiments, the curable compositions comprises one or more THFA copolymers in an amount of from 15-50 parts (e.g., 25-35 parts), by weight based on 100 parts total weight of monomers/copolymers in the curable compositions.

Curable compositions may include one or more thermoplastic polyesters. Suitable polyester components include semi-crystalline polyesters as well as amorphous and branched polyesters. But in some embodiments, the curable compositions of the various embodiments described herein contain substantially no thermoplastic polyesters; no more than trace amounts of thermoplastic polyesters; or amounts that will not materially affect the characteristics of the curable compositions.

Thermoplastic polyesters may include polycaprolactones and polyesters having hydroxyl and carboxyl termination, and may be amorphous or semi-crystalline at room temperature. In some embodiments, the polyesters are hydroxyl terminated polyesters that are semi-crystalline at room temperature. A material that is "amorphous" has a glass transition temperature but does not display a measurable crystalline melting point as determined on a differential scanning calorimeter ("DSC"). In some embodiments, the glass transition temperature is less than about 100° C. A material that is "semi-crystalline" displays a crystalline melting point as determined by DSC, in some embodiments, with a maximum melting point of about 120° C.

Crystallinity in a polymer can also be reflected by the clouding or opaqueness of a sheet that had been heated to an amorphous state as it cools. When the polyester polymer is heated to a molten state and knife-coated onto a liner to form a sheet, it is amorphous and the sheet is observed to be clear and fairly transparent to light. As the polymer in the sheet material cools, crystalline domains form and the crystallization is characterized by the clouding of the sheet to a translucent or opaque state. The degree of crystallinity may be varied in the polymers by mixing in any compatible combination of amorphous polymers and semi-crystalline polymers having varying degrees of crystallinity. It is generally preferred that material heated to an amorphous state be allowed sufficient time to return to its semi-crystalline state before use or application. The clouding of the sheet provides a convenient non-destructive method of determining that crystallization has occurred to some degree in the polymer.

The polyesters may include nucleating agents to increase the rate of crystallization at a given temperature. Useful nucleating agents include microcrystalline waxes. A suitable wax could include an alcohol comprising a carbon chain having a length of greater than 14 carbon atoms (CAS #71770-71-5) or an ethylene homopolymer (CAS #9002-88-4) sold by Baker Hughes, Houston, TX, as UNILIN™ 700.

In some embodiments, the polyesters are solid at room temperature. The polyesters can have a number average molecular weight of about 7,500 g/mol to 200,000 g/mol (e.g., from about 10,000 g/mol to 50,000 g/mol and from about 15,000 g/mol to 30,000 g/mol).

Polyesters useful for use in the curable compositions of the various embodiments described herein comprise the reaction product of dicarboxylic acids (or their diester equivalents) and diols. The diacids (or diester equivalents) can be saturated aliphatic acids containing from 4 to 12 carbon atoms (including branched, unbranched, or cyclic materials having 5 to 6 carbon atoms in a ring) and/or aromatic acids containing from 8 to 15 carbon atoms. Examples of suitable aliphatic acids are succinic, glutaric, adipic, pimelic, suberic, azelaic, sebacic, 1,12-dodecanedioic, 1,4-cyclohexanedicarboxylic, 1,3-cyclopentanedicarboxylic, 2-methylsuccinic, 2-methylpentanedioic, 3-methylhexanedioic acids, and the like. Suitable aromatic acids include terephthalic acid, isophthalic acid, phthalic acid, 4,4'-benzophenone dicarboxylic acid, 4,4'-diphenylmethanedicarboxylic acid, 4,4'-diphenylthioether dicarboxylic acid, and 4,4'-diphenylamine dicarboxylic acid. In some embodiments, the structure between the two carboxyl groups in the diacids contain only carbon and hydrogen atoms. In some specific embodiments, the structure between the two carboxyl groups in the diacids is a phenylene group. Blends of the foregoing diacids may be used.

The diols include branched, unbranched, and cyclic aliphatic diols having from 2 to 12 carbon atoms. Examples of suitable diols include ethylene glycol, 1,3-propylene glycol, 1,2-propylene glycol, 1,4-butanediol, 1,3-butanediol, 1,5-pentanediol, 2-methyl-2,4-pentanediol, 1,6-hexanediol, cyclobutane-1,3-di($2^1$-ethanol), cyclohexane-1,4-dimethanol, 1,10-decanediol, 1,12-dodecanediol, and neopentyl glycol. Long chain diols including poly(oxyalkylene)glycols in which the alkylene group contains from 2 to 9 carbon atoms (e.g., 2 to 4 carbon atoms), may also be used. Blends of the foregoing diols may be used.

Useful, commercially available hydroxyl terminated polyester materials include various saturated linear, semi-crystalline copolyesters available from Evonik Industries, Essen, North Rhine-Westphalia, Germany, such as DYNAPOL™ S1401, DYNAPOL™ S1402, DYNAPOL™ S1358, DYNAPOL™ S1359, DYNAPOL™ S1227, and DYNAPOL™ S1229. Useful saturated, linear amorphous copolyesters available from Evonik Industries include DYNAPOL™ 1313 and DYNAPOL™ S1430.

The curable compositions may include one or more thermoplastic polyesters in an amount that varies depending on the desired properties of the abrasive layer. In some embodiments, the curable compositions include one or more thermoplastic polyesters in an amount of up to 50 percent by weight, based on the total weight of monomers/copolymers in the curable compositions. Where present, the one or more thermoplastic polyesters are present, in some embodiments, in an amount of at least 5 percent, at least 10 percent, at least 12 percent, at least 15 percent, or at least 20 percent by weight based on the total weight of monomers/copolymers in the composition. Where present, the one or more thermoplastic polyesters are, in some embodiments, present in an amount of at most 20 percent, at most 25 percent, at most 30 percent, at most 40 percent, or at most 50 percent by weight based on the total weight of monomers/copolymers in the curable compositions.

In some embodiments, the curable compositions comprise one or more epoxy resins, which are polymers comprising at least one epoxide functional group. Epoxy resins or epoxides that are useful in the composition of the present disclosure may be any organic compound having at least one oxirane ring that is polymerizable by ring opening. In some examples, the average epoxy functionality in the epoxy resins is greater than one, and, in some instances, at least two. The epoxides can be monomeric or polymeric, and aliphatic, cycloaliphatic, heterocyclic, aromatic, hydrogenated, or mixtures thereof. In some examples, epoxides contain more than 1.5 epoxy group per molecule and, in some instances, at least 2 epoxy groups per molecule. The useful materials typically have a weight average molecular weight of 150 g/mol to 10,000 g/mol (e.g., 180 g/mol to 1,000 g/mol). The molecular weight of the epoxy resin can be selected to provide the desired properties of the curable compositions or the cured compositions. Suitable epoxy resins include linear polymeric epoxides having terminal epoxy groups (e.g., a diglycidyl ether of a polyoxyalkylene glycol), polymeric epoxides having skeletal epoxy groups (e.g., polybutadiene poly epoxy), and polymeric epoxides having pendant epoxy groups (e.g., a glycidyl methacrylate polymer or copolymer), and mixtures thereof. The epoxide-containing materials include compounds having the general formula:

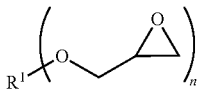

wherein $R^1$ is alkyl, alkoxy or aryl and n is an integer from 1 to 6.

Epoxy resins include aromatic glycidyl ethers, e.g., such as those prepared by reacting a polyhydric phenol with an excess of epichlorohydrin, cycloaliphatic glycidyl ethers, hydrogenated glycidyl ethers, and mixtures thereof. Such polyhydric phenols may include resorcinol, catechol, hydroquinone, and the polynuclear phenols such as p,p'-dihydroxydibenzyl, p,p'-dihydroxydiphenyl, p,p'-dihydroxyphenyl sulfone, p, p'-dihydroxybenzophenone, 2,2'-dihydroxy-1,1-dinaphthylmethane, and the 2,2', 2,3', 2,4', 3,3', 3,4', and 4,4' isomers of dihydroxydiphenylmethane, dihydroxydiphenyldimethylmethane, dihydroxydiphenylethylmethylmethane, dihydroxydiphenylmethylpropylmethane, dihydroxydiphenylethylphenylmethane, dihydroxydiphenylpropylphenylmethane, dihydroxydiphenylbutylphenylmethane, dihydroxydiphenyltolylethane, dihydroxydiphenyltolylmethylmethane, dihydroxydiphenyldicyclohexylmethane, and dihydroxydiphenylcyclohexane.

Also useful are polyhydric phenolic formaldehyde condensation products as well as polyglycidyl ethers that contain as reactive groups only epoxy groups or hydroxy groups. Useful curable epoxy resins are also described in various publications including, for example, Lee and Nevil, Handbook of Epoxy Resins (McGraw-Hill Book Co. 1967) and Encyclopedia of Polymer Science and Technology, 6, p. 322 (1986).

The choice of the epoxy resin used can depend upon its intended end use. For example, epoxides with "flexible backbones" may be desired where a greater amount of ductility is needed. Materials such as diglycidyl ethers of bisphenol A and diglycidyl ethers of bisphenol F can provide desirable structural properties that these materials attain upon curing, while hydrogenated versions of these epoxies may be useful for compatibility with substrates having oily surfaces.

Examples of commercially available epoxides useful in the present disclosure include diglycidyl ethers of bisphenol A (e.g., those available under the trade names EPON™ 828, EPON™ 1001, EPON™ 1004, EPON™ 2004, EPON™ 1510, and EPON™ 1310 from Momentive Specialty Chemicals, Inc., Waterford, NY; those under the trade designations D.E.R.™ 331, D.E.R.™ 332, D.E.R.™ 334, and DEN.™ 439 available from Dow Chemical Co., Midland, MI; and those available under the trade name EPONEX™ 1510 available from Hexion); diglycidyl ethers of bisphenol F (that are available, e.g., under the trade designation ARALDITE™ GY 281 available from Huntsman Corporation); silicone resins containing diglycidyl epoxy functionality; flame retardant epoxy resins (e.g., that are available under the trade designation D.E.R.™ 560, a brominated bisphenol type epoxy resin available from Dow Chemical Co.); and 1,4-butanediol diglycidyl ethers.

Epoxy containing compounds having at least one glycidyl ether terminal portion, and in some instances, a saturated or unsaturated cyclic backbone may optionally be added to the curable compositions as reactive diluents. Reactive diluents may be added for various purposes such as to aid in processing, e.g., to control the viscosity in the curable compositions as well as during curing, make the cured composition more flexible, and/or compatibilize materials in the composition.

Examples of such diluents include: diglycidyl ether of cyclohexanedimethanol, diglycidyl ether of resorcinol, p-tert-butyl phenyl glycidyl ether, cresyl glycidyl ether, diglycidyl ether of neopentyl glycol, triglycidyl ether of trimethylolethane, triglycidyl ether of trimethylolpropane, triglycidyl p-amino phenol, N,N'-diglycidylaniline, N,N,N'N'-tetraglycidyl meta-xylylene diamine, and vegetable oil polyglycidyl ether. Reactive diluents are commercially available as HELOXY™ 107 and CARDURA™ N10 from Momentive Specialty Chemicals, Inc. The composition may contain a toughening agent to aid in providing, among other features, peel resistance and impact strength.

The curable compositions can contain one or more epoxy resins having an epoxy equivalent weight of from 100 g/mol to 1500 g/mol. In some instances, the curable compositions contain one or more epoxy resins having an epoxy equivalent weight of from 300 g/mol to 1200 g/mol. And in other embodiments, the curable compositions of the various embodiments described herein contain two or more epoxy resins, wherein at least one epoxy resin has an epoxy equivalent weight of from 300 g/mol to 500 g/mol, and at least one epoxy resin has an epoxy equivalent weight of from 1000 g/mol to 1200 g/mol.

The curable compositions may comprise one or more epoxy resins in an amount, which varies depending on the desired properties of the curable compositions that make up the abrasive layer of the abrasive article of the various embodiments described herein. In some embodiments, the curable compositions comprise one or more epoxy resins in an amount of at least 20, at least 25, at least 35, at least 40, at least 50 parts, or at least 55 parts by weight, based on the 100 parts total weight of the composition. In some embodiments, the one or more epoxy resins are present in an amount of at most 45, at most 50 parts, at most 75 parts, or at most 80 parts by weight, based on the 100 parts total weight of the monomers/copolymers in the curable compositions.

Vinyl ethers represent a different class of monomers that, like epoxy resins, are cationic polymerizable. These monomers can be used as an alternative to, or in combination with, the epoxy resins disclosed herein.

While not wishing to be bound by any specific theory, it is believed that the vinyl ether monomer has a high electron density of double bonds and produces a stable carbocation, enabling this monomer to have high reactivity in cationic polymerizations. To avoid inhibiting the cationic polymerization, the vinyl ether monomer may be limited to those not containing nitrogen. Examples thereof include methyl vinyl ether, ethyl vinyl ether, tert-butyl vinyl ether, isobutyl vinyl ether, triethylene glycol divinyl ether, and 1,4-cyclohexane dimethanol divinyl ether. Preferred examples of the vinyl ether monomer include triethylene glycol divinyl ether and cyclohexane dimethanol divinyl ether (both sold under the trade designation RAPI-CURE by Ashland, Inc., Covington, Kentucky.).

The curable compositions can further include one or more hydroxy-functional polyether. In some embodiments, the one or more hydroxy-functional polyether is a liquid at a temperature of 25° C. and pressure of 1 atm (101 kilopascals). In some embodiments, the one or more hydroxy-functional polyethers include a polyether polyol. The polyether polyol can be present in an amount of at least 5 parts, at least 10 parts, or at most 15 parts relative to 100 parts total weight of monomers/copolymers in the composition. In some embodiments, the polyether polyol is present in an amount of at most 15 parts, at most 20 parts, or at most 30 parts relative to 100 parts total weight of monomers/copolymers in the composition.

Examples of hydroxy-functional polyethers include, but are not limited to, polyoxyethylene and polyoxypropylene glycols; polyoxyethylene and polyoxypropylene triols and polytetramethylene oxide glycols.

Suitable hydroxy-functional poly(alkylenoxy) compounds include, but are not limited to, the POLYMEG™ series of polytetramethylene oxide glycols (from Lyondellbasell, Inc., Jackson, TN), the TERATHANE™ series of polytetramethylene oxide glycols (from Invista, Newark, DE); the POLYTHF™ series of polytetramethylene oxide glycol (from BASF SE, Ludwigshafen, Germany); the ARCOL™ series of polyoxypropylene polyols (from Bayer MaterialScience LLC, Pittsburgh, PA) and the VORANOL™ series of polyether polyols (from Dow Chemical Company, Midland, MI).

The curable compositions of the various embodiments described herein, that are used to form the abrasive layer can further contain at least one polyhydroxyl-functional compound having at least one and, in some instances, at least two hydroxyl groups. As used herein, the term "polyhydroxyl-functional compound" does not include the polyether polyols described herein, which also contain hydroxyl groups. In some embodiments, the polyhydroxyl-functional compounds are substantially free of other "active hydrogen" containing groups such as amino and mercapto moieties. Further, the polyhydroxyl-functional compounds can also be substantially free of groups, which may be thermally and/or photolytically unstable so that the compounds will not decompose when exposed to UV radiation and, in some instances, heat during curing.

The polyhydroxyl-functional compound contains, in some instances, two or more primary or secondary aliphatic hydroxyl groups (i.e., the hydroxyl group is bonded directly to a non-aromatic carbon atom). In some embodiments, the polyhydroxyl-functional compound has a hydroxyl number of at least 0.01. While not wishing to be bound by any specific theory, it is believed the hydroxyl groups participate in the cationic polymerization with the epoxy resin.

The polyhydroxyl-functional compound may be selected from phenoxy resins, ethylene-vinyl acetate ("EVA") copolymers, polycaprolactone polyols, polyester polyols, and polyvinyl acetal resins that are solid under ambient conditions. In some embodiments, the polyhydroxyl-functional compound is solid at a temperature of 25° C. and pressure of 1 atm (101 kilopascals). The hydroxyl group may be terminally situated, or may be pendent from a polymer or copolymer. In some embodiments, the addition of a polyhydroxyl-functional compound to the curable compositions of the various embodiments described herein can improve the dynamic overlap shear strength and/or decrease the cold flow of the curable compositions used to make the abrasive layer.

One useful class of polyhydroxyl-functional compound is hydroxy-containing phenoxy resins. Desirable phenoxy resins include those derived from the polymerization of a diglycidyl bisphenol compound. Typically, the phenoxy resin has a number average molecular weight of less than 60,000 g/mol (e.g., in the range of 20,000 g/mol to 30,000 g/mol). Commercially available phenoxy resins include, but are not limited to, PAPHEN™ PKHP-200, available from Inchem Corp., Rock Hill, SC and the SYN FACT™ series of polyoxyalkylated bisphenol A from Milliken Chemical, Spartanburg, SC) such as SYN FACT™ 8009, 8024, 8027, 8026, and 8031.

Another useful class of polyhydroxyl-functional compound is that of EVA copolymer resins. While not wishing to be bound by any specific theory, it is believed that these resins contain small amounts of free hydroxyl groups, and that EVA copolymers are further deacetylated during cationic polymerization. Hydroxyl-containing EVA resins can be obtained, for example, by partially hydrolyzing a precursor EVA copolymer.

Suitable ethylene-vinyl acetate copolymer resins include, but are not limited to, thermoplastic EVA copolymer resins containing at least 28 percent by weight vinyl acetate. In one embodiment, the EVA copolymer comprises a thermoplastic copolymer containing at least 28 percent by weight vinyl acetate, desirably at least 40 percent by weight vinyl acetate (e.g., at least 50 percent by weight vinyl acetate and at least 60 percent by weight vinyl acetate) by weight of the copolymer. In a further embodiment, the EVA copolymer contains an amount of vinyl acetate in the range of from 28 to 99 weight percent of vinyl acetate (e.g., from 40 to 90 weight percent of vinyl acetate; from 50 to 90 weight percent of vinyl acetate; and from 60 to 80 weight percent vinyl acetate) in the copolymer.

Examples of commercially available EVA copolymers include, but are not limited to, the ELVAX™ series, including ELVAX™ 150, 210, 250, 260, and 265 from E. I. Du Pont de Nemours and Co., Wilmington, DE, ATEVA™ series from Celanese, Inc., Irving, TX); LEVAPREN™ 400 from Bayer Corp., Pittsburgh, PA including LEVAPREN™ 450, 452, and 456 (45 weight percent vinyl acetate); LEVAPREN™ 500 HV (50 weight percent vinyl acetate); LEVAPREN™ 600 HV (60 weight percent vinyl acetate); LEVAPREN™ 700 HV (70 weight percent vinyl acetate); and LEVAPREN™ KA 8479 (80 weight percent vinyl acetate), each from Lanxess Corp., Cologne, Germany.

Additional useful polyhydroxyl-functional compounds include the TONE™ series of polycaprolactone polyols series available from Dow Chemical, the CAPA™ series of polycaprolactone polyols from Perstorp Inc., Perstorp, Sweden, and the DESMOPHEN™ series of saturated polyester polyols from Bayer Corporation, Pittsburgh, PA, such as DESMOPHEN™ 631A 75.

The curable composition comprises at least one polyhydroxyl-functional compound in an amount, which can vary depending on the desired properties of the curable composition, whether cured or uncured. The curable composition can include at least one polyhydroxyl-functional compound in an amount of at least 10 parts, at least 15 parts, at least 20 parts, or at least 25 parts by weight, based on 100 parts total weight of monomers/copolymers in the composition. In some embodiments, the at least one polyhydroxyl-functional compound can be present in an amount of at most 20 parts, at most 25 parts, or at most 50 parts, based on 100 parts total weight of monomers/copolymers in the composition.

Useful photoinitiators for use in the curable compositions of the various embodiments described herein include photoinitiators used to i) polymerize precursor polymers (for example, in some embodiments, tetrahydrofurfuryl (meth) acrylate copolymer) and ii) those used to ultimately polymerize the curable compositions.

Photoinitiators for the former include benzoin ethers such as benzoin methyl ether and benzoin isopropyl ether; substituted acetophenones such as 2,2 dimethoxy-1,2-diphenylethanone, available as IRGACURE™ 651 (BASF SE) or ESACURE™ KB-1 (Sartomer Co., West Chester, PA), dimethoxyhydroxyacetophenone; substituted α-ketols such as 2-methyl-2-hydroxy propiophenone; aromatic sulfonyl chlorides such as 2-naphthalene-sulfonyl chloride; and photoactive oximes such as 1-phenyl-1,2-propanedione-2-(O-ethoxy-carbonyl)oxime. In some specific embodiments, the photoinitiators are substituted acetophenones.

In some embodiments, photoinitiators are photoactive compounds that undergo a Norrish I cleavage to generate free radicals that can initiate by addition to the acrylic double bonds. In some embodiments, such photoinitiators are present in an amount of from 0.1 to 1.0 pbw per 100 parts of the precursor polymer composition. Examples of such photoinitiators include, but are not limited to, ionic photoacid generators, which are compounds that can generate acids upon exposure to actinic radiation. These are extensively used to initiate cationic polymerizations, in which case they are referred to as cationic photoinitiators.

Useful ionic photoacid generators include bis(4-t-butylphenyl) iodonium hexafluoroantimonate (FP5034™ from Hampford Research Inc., Stratford, CT), a mixture of triarylsulfonium salts (diphenyl(4-phenylthio) phenylsufonium hexafluoroantimonate, bis(4-(diphenylsulfonio)phenyl)sulfide hexafluoroantimonate) available as Syna PI-6976™ from Synasia Metuchen, NJ, (4-methoxyphenyl) phenyl iodonium triflate, bis(4-fert-butylphenyl) iodonium camphorsulfonate, bis(4-tert-butylphenyl) iodonium hexafluoroantimonate, bis(4-tert-butylphenyl) iodonium hexafluorophosphate, bis(4-tert-butylphenyl) iodonium tetraphenylborate, bis(4-tert-butylphenyl) iodonium tosylate, bis(4-tert-butylphenyl) iodonium triflate, ([4-(octyloxy)phenyl]phenyliodonium hexafluorophosphate), ([4-(octyloxy) phenyl]phenyliodonium hexafluoroantimonate), (4-isopropylphenyl)(4-methylphenyl)iodonium tetrakis (pentafluorophenyl) borate (available as Rhodorsil 2074™ from Bluestar Silicones, East Brunswick, NJ), bis(4-methylphenyl) iodonium hexafluorophosphate (available as Omnicat 440™ from IGM Resins Bartlett, IL), 4-(2-hydroxy-1-tetradecycloxy)phenyl]phenyl iodonium hexafluoroantimonate, triphenyl sulfonium hexafluoroantimonate (available as CT-548™ from Chitec Technology Corp. Taipei, Taiwan), diphenyl(4-phenylthio)phenylsufonium hexafluorophosphate, bis(4-(diphenylsulfonio)phenyl)sulfide bis(hexafluorophosphate), diphenyl(4-phenylthio)phenylsufonium hexafluoroantimonate, bis(4-(diphenylsulfonio)phenyl)sulfide hexafluoroantimonate, and blends of these triarylsulfonium salts available from Synasia, Metuchen, NJ as SYNA™ PI-6992 and SYNA™ PI-6976 for the PF6 and SbF6 salts, respectively. Similar blends of ionic photoacid generators are available from Aceto Pharma Corporation, Port Washington, NY as UVI-6992 and UVI-6976.

The photoinitiator is used in amounts sufficient to effect the desired degree of crosslinking of the copolymer. The desired degree of crosslinking may vary, depending on the desired properties of the abrasive layer (whether cured or uncured) or the thickness of the abrasive layer (whether cured or uncured). The amount of the photoinitiator necessary to effect the desired degree of crosslinking will depend on the quantum yield of the photoinitiator (the number of molecules of acid released per photon absorbed), the permeability of the polymer matrix, the wavelength and duration of irradiation and the temperature. Generally the photoinitiator is used in amounts of at least 0.001 parts, at least 0.005 parts, at least 0.01 parts, at least 0.05 parts, at least 0.1 parts, or at least 0.5 parts by weight relative to 100 parts by weight of total monomer/copolymer in the composition. The photoinitiator is generally used in amounts of at most 5 parts, at most 3 parts, at most 1 part, at most 0.5 parts, at most 0.3 parts, or at most 0.1 parts by weight relative to 100 parts by weight of total monomer/copolymer in the composition.

The curable compositions of the various embodiments described herein may further contain any of a number of optional additives. Such additives may be homogeneous or heterogeneous with one or more components in the composition. Heterogenous additives may be discrete (e.g., particulate) or continuous in nature.

Aforementioned additives can include, for example, fillers, stabilizers, plasticizers, tackifiers, flow control agents, cure rate retarders, adhesion promoters (for example, silanes such as (3-glycidoxypropyl)trimethoxysilane (GPTMS), and titanates), adjuvants, impact modifiers, expandable microspheres, thermally conductive particles, electrically conductive particles, and the like, such as silica, glass, clay, talc, pigments, colorants, glass beads or bubbles, and antioxidants, so as to reduce the weight and/or cost of the structural layer composition, adjust viscosity, and/or provide additional reinforcement or modify the thermal conductivity of compositions and articles used in the provided methods so that a more rapid or uniform cure may be achieved.

In some embodiments, the curable compositions can contain one or more fiber reinforcement materials. The use of a fiber reinforcement material can provide an abrasive layer having improved cold flow properties, limited stretchability, and enhanced strength. Preferably, the one or more fiber reinforcement materials have a certain degree of porosity that enables the photoinitiator, which can be dispersed throughout the, to be activated by UV light and properly cured without the need for heat.

The one or more fiber reinforcements may comprise one or more fiber-containing webs including, but not limited to, woven fabrics, nonwoven fabrics, knitted fabrics, and a unidirectional array of fibers. The one or more fiber reinforcements could comprise a nonwoven fabric, such as a scrim.

Materials for making the one or more fiber reinforcements may include any fiber-forming material capable of being formed into one of the above-described webs. Suitable fiber-forming materials include, but are not limited to, polymeric materials such as polyesters, polyolefins, and aramids; organic materials such as wood pulp and cotton; inorganic materials such as glass, carbon, and ceramic; coated fibers having a core component (e.g., any of the above fibers) and a coating thereon; and combinations thereof.

Further options and advantages of the fiber reinforcement materials are described in U.S. Patent Publication No. 2002/0182955 (Weglewski et al.).

In some examples, the curable composition of the various embodiments described herein does not require heat for curing, although heat can be used to accelerate the curing process. Further, in some embodiments, the curable composition is prepared using a hot melt process, thereby avoiding the need for volatile solvents, since solvents are often undesirable because of costs associated with procurement, handling, and disposal.

As discussed herein, the polymerizable composition used to form the THFA copolymer component, the curable compositions used to form the abrasive layer, and/or the compositions used to make the size coat may be irradiated using various activating UV light sources to polymerize (e.g., photopolymerize) one or more component(s).

Light sources based on light emitting diodes can enable a number of advantages. These light sources can be monochromatic, which for the purposes of this disclosure implies that the spectral power distribution is characterized by a very narrow wavelength distribution (e.g., confined within a 50 nm range or less). Monochromatic ultraviolet light can reduce thermal damage or harmful deep UV effects to coatings and substrates being irradiated. In larger scale applications, the lower power consumption of UV-LED sources can also allow for energy savings and reduced environmental impact.

In some embodiments, matching the spectral power distribution of the photoinitiator with the absorption spectrum of UV light source too closely can result in inferior curing of thick abrasive layers. While not wishing to be bound by any specific theory, it is believed that aligning the peak output of the UV source with the excitation wavelength of the photoinitiator can be undesirable because it leads to formation of a "skin" layer that dramatically increases the viscosity of the monomer mixture and progressively hinders the ability of available monomer to access reactive polymer chain ends. The result of this lack of access is a layer of uncured, or only partially cured, abrasive layer beneath the skin layer and subsequent failure of the abrasive layer to, e.g., retain abrasive particles.

This technical problem can be alleviated by using a UV light source with a spectral power distribution that is offset from the primary excitation wavelength at which the photoinitiator is activated. As used herein, "offset" between the spectral power distribution and a given wavelength means that the given wavelength does not overlap with wavelengths over which the output of the UV light source has significant intensity. In one embodiment, the offset referred to above is a positive offset (e.g., the spectral power distribution spans wavelengths that are higher than the primary excitation wavelength of the photoinitiator).

In this disclosure, the primary excitation wavelength can be defined at the highest wavelength absorption peak (e.g., the local maximum absorption peak located at the highest wavelength) in the UV absorption curve of the photoinitiator, as determined by spectroscopic measurement at a photoinitiator concentration of 0.03 wt % in acetonitrile solution.

In some embodiments, the highest wavelength absorption peak is located at a wavelength of at most 395 nm, at most 375 nm, or at most 360 nm.

In some embodiments, the difference in wavelength between the highest wavelength absorption peak of the photoinitiator and the peak intensity of the UV light source is in the range of from 30 nm to 110 nm, preferably from 40 nm to 90 nm, and more preferably from 60 nm to 80 nm.

The UV radiation exposure time required to obtain sufficient activation of the photoinitiator(s) is not particularly restricted. In some embodiments, the curable composition is exposed to ultraviolet radiation over an exposure period of at least 0.25 seconds, at least 0.35 seconds, at least 0.5 seconds, or at least 1 second. The curable composition can be exposed to ultraviolet radiation over an exposure period of at most 10 minutes, at most 5 minutes, at most 2 minutes, at most 1 minute, or at most 20 seconds.

Based on the exposure time used, the UV radiation should provide a sufficient energy density to obtain a functional cure. In some embodiments, the UV radiation can deliver an energy density of at least 0.5 J/cm$^2$, at least 0.75 J/cm$^2$, or at least 1 J/cm$^2$. In the same or alternative embodiments, the UV radiation can deliver an energy density of at most 15 J/cm$^2$, at most 12 J/cm$^2$, or at most 10 J/cm$^2$.

A wide variety of abrasive particles may be utilized in the various embodiments described herein. Suitable abrasive particles may be, for example, alumina, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof.

The abrasive particles may be provided in a variety of sizes, shapes and profiles, including, for example, random or crushed shapes, regular (e.g. symmetric) profiles such as square, star-shaped or hexagonal profiles, and irregular (e.g. asymmetric) profiles.

The abrasive article may include a mixture of different types of abrasive particles. For example, the abrasive article may include mixtures of platey and non-platey particles, crushed and shaped particles (which may be discrete abrasive particles that do not contain a binder or agglomerate abrasive particles that contain a binder), conventional non-shaped and non-platey abrasive particles (e.g. filler material) and abrasive particles of different sizes.

Examples of suitable shaped abrasive particles can be found in, for example, U.S. Pat. No. 5,201,916 (Berg) and U.S. Pat. No. 8,142,531 (Adefris et al.) A material from which the shaped abrasive particles may be formed comprises alpha alumina. Alpha alumina shaped abrasive particles can be made from a dispersion of aluminum oxide monohydrate that is gelled, molded to shape, dried to retain the shape, calcined, and sintered according to techniques known in the art.

U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them). Details concerning such shaped abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Examples of suitable crushed abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.).

Examples of sol-gel-derived abrasive particles from which crushed abrasive particles can be isolated, and methods for their preparation can be found in U.S. Pat. No. 4,314,827 (Leitheiser et al.); U.S. Pat. No. 4,623,364 (Cottringer et al.); U.S. Pat. No. 4,744,802 (Schwabe)), U.S. Pat. No. 4,770,671 (Monroe et al.); and U.S. Pat. No. 4,881,951 (Monroe et al.). It is also contemplated that the crushed abrasive particles could comprise abrasive agglomerates such as, for example, those described in U.S. Pat. No. 4,652,275 (Bloecher et al.) or U.S. Pat. No. 4,799,939 (Bloecher et al.).

The crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Patent Publication No. 2009/0165394 A1 (Culler et al.). Examples of suitable platey crushed abrasive particles can be found in, for example, U.S. Pat. No. 4,848,041 (Kruschke).

The abrasive particles may be surface-treated with a coupling agent (e.g., an organosilane coupling agent) or other physical treatment (e.g., iron oxide or titanium oxide) to enhance adhesion of the crushed abrasive particles to the binder.

The abrasive layer, in some embodiments, includes a particulate mixture comprising a plurality of formed abrasive particles (e.g., precision shaped grain (PSG) mineral particles available from 3M, St. Paul, MN, which are described in greater detail herein; not shown in FIG. 1, 3A, 3B, 4A or 4B) and a plurality of abrasive particles 106, or only formed abrasive particles, adhesively secured to the abrasive layer.

As used herein, the term "formed abrasive particles" generally refers to abrasive particles (e.g., formed ceramic abrasive particles) having at least a partially replicated shape. Non-limiting processes to make formed abrasive particles include shaping the precursor abrasive particle in a mold having a predetermined shape, extruding the precursor abrasive particle through an orifice having a predetermined shape, printing the precursor abrasive particle though an opening in a printing screen having a predetermined shape, or embossing the precursor abrasive particle into a predetermined shape or pattern. Non-limiting examples of formed abrasive particles are disclosed in Published U.S. Patent Appl. No. 2013/0344786, which is incorporated by reference as if fully set forth herein. Non-limiting examples of formed abrasive particles include shaped abrasive particles formed in a mold, such as triangular plates as disclosed in U.S. Pat. Nos. RE 35,570; 5,201,916, and 5,984,998 all of which are incorporated by reference as if fully set forth herein; or extruded elongated ceramic rods/filaments often having a circular cross section produced by Saint-Gobain Abrasives an example of which is disclosed in U.S. Pat. No. 5,372,620, which is incorporated by reference as if fully set forth herein. Formed abrasive particle as used herein excludes randomly sized abrasive particles obtained by a mechanical crushing operation.

Formed abrasive particles also include shaped abrasive particles. As used herein, the term "shaped abrasive particle," generally refers to abrasive particles with at least a portion of the abrasive particles having a predetermined shape that is replicated from a mold cavity used to form the shaped precursor abrasive particle. Except in the case of abrasive shards (e.g. as described in U.S. patent publication US 2009/0169816), the shaped abrasive particle will generally have a predetermined geometric shape that substantially replicates the mold cavity that was used to form the shaped abrasive particle. Shaped abrasive particle as used herein excludes randomly sized abrasive particles obtained by a mechanical crushing operation.

Formed abrasive particles also include "platey crushed abrasive particles," such as those described in Published PCT Appl. No. WO2016/160357, which is incorporated by reference as if fully set forth herein. Briefly, the term "platey crushed abrasive particle," generally refers to crushed abrasive particles resembling a platelet and/or flake that is characterized by a thickness that is less than the width and length. For example, the thickness may be less than ½, ⅓, ¼, ⅕, ⅙, ⅐, ⅛, ⅑, or even less than 1/10 of the length and/or width. Likewise, the width may be less than ½, ⅓, ¼, ⅕, ⅙, ⅐, ⅛, ⅑, or even less than 1/10 of the length.

Formed abrasive particles also include precision-shaped grain (PSG) mineral particles, such as those described in Published U.S. Appl. No. 2015/267097, which is incorporated by reference as if fully set forth herein.

The formed abrasive particles and the abrasive particles can be made of the same or different materials. For example, formed abrasive particles and the abrasive particles 106 are not limited and may be composed of any of a variety of hard minerals known in the art. Examples of suitable abrasive particles include, for example, fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles, silica, iron oxide, chromia, ceria, zirconia, titania, tin oxide, gamma alumina, and mixtures thereof. The alumina abrasive particles may contain a metal oxide modifier. The diamond and cubic boron nitride abrasive particles may be monocrystalline or polycrystalline.

The formed abrasive particles can be made according to methods known in the art including the methods described in Published U.S. Appl. No. 2015/267097, which is incorporated by reference as if fully set forth herein.

In some examples, the formed abrasive particles have a substantially monodisperse particle size of from about 80 micrometers to about 150 micrometers (e.g., from about 75 micrometers to about 150 micrometers; about 90 micrometers to about 110 micrometers; about 90 micrometers to about 100 micrometers; about 85 micrometers to about 110 micrometers; or about 95 micrometers to about 120 micrometers). As used herein, the term "substantially monodisperse particle size" is used to describe formed abrasive particles having a size that does not vary substantially. Thus, for example, when referring to formed abrasive particles (e.g., a PSG mineral particles) having a particle size of 100 micrometers, greater than 90%, greater than 95% or greater than 99% of the formed abrasive particles will have a particle having its largest dimension be 100 micrometers.

In contrast, the abrasive particles 106 can have a range or distribution of particle sizes. Such a distribution can be characterized by its median particle size. For instance, the median particle size of the abrasive particles may be at least at least 0.01 micrometers, at least 0.10 micrometers, at least 0.50 micrometers, at least 5 micrometers, at least 10 micrometers or even at least 20 micrometers. In some instances, the median particle size of the abrasive particles may be up to 1000 micrometers, may be up to 800 micrometers, up to 600 micrometers, up to 400 micrometers, up to 300 micrometers, up to 250 micrometers, up to 150 micrometers, or even up to 100 micrometers. In some examples, the median particle size of the abrasive particles is from about 10 micrometers to about 800 micrometers, from about 20 micrometers to about 800 micrometers, from about 40 micrometers to about 800 micrometers, from about 10 micrometers to about 600 micrometers, from about 20 micrometers to about 600 micrometers, from about 40 micrometers to about 600 micrometers, from about 10 micrometers to about 400 micrometers, from about 20 micrometers to about 400 micrometers, or even from about 40 micrometers to about 800 micrometers.

In some embodiments, the formed abrasive particles and the abrasive particles are present in the particulate mixture comprised in the abrasive layer in different weight percent (wt. %) amounts relative to one another, based on the overall weight of the particulate mixture. In some examples, the particulate mixture comprises from about 1 wt. % to less than 99 wt. % formed abrasive particles, from about 2 wt. % to less than 50 wt. % formed abrasive particles, from about 3 wt. % to less than 20 wt. % formed abrasive particles.

In some embodiments, the abrasive article of the various embodiments described herein include a size coat 202. In some examples, the size coat comprises the cured (e.g., photopolymerized) product of a bis-epoxide (e.g., 3,4-epoxy cyclohexylmethyl-3,4-epoxy cyclohexylcarboxylate, available from Daicel Chemical Industries, Ltd., Tokyo, Japan); a trifunctional acrylate (e.g., trimethylol propane triacrylate, available under the trade designation "SR351" from Sartomer USA, LLC, Exton, PA); an acidic polyester dispersing agent (e.g., "BYK W-985" from Byk-Chemie, GmbH, Wesel, Germany); a filler (e.g., a sodium-potassium alumina silicate filler, obtained under the trade designation "MINEX 10" from The Cary Company, Addison, IL); a photoinitiator (e.g., a triarylsulfonium hexafluoroantimonate/propylene carbonate photoinitiator, obtained under the trade designation "CYRACURE CPI 6976" from Dow Chemical Company, Midland, MI; and an α-Hydroxyketone photoinitiator, obtained under the trade designation "DAROCUR 1173" from BASF Corporation, Florham Park, NJ).

The abrasive article of the various embodiments described include a supersize coat 204. In general, the supersize coat is the outermost coating of the abrasive article and directly contacts the workpiece during an abrading operation. The supersize coat is, in some examples, substantially transparent.

The term "substantially transparent" as used herein refers to a majority of, or mostly, as in at least about 30%, 40%, 50%, 60%, or at least about 70% or more transparent. In some examples, the measure of the transparency of any given coat described herein (e.g., the supersize coat) is the coat's transmittance. In some examples, the supersize coat displays a transmittance of at least 5 percent, at least 20 percent, at least 40 percent, at least 50 percent, or at least 60 percent (e.g., a transmittance from about 40 percent to about 80 percent; about 50 percent to about 70 percent; about 40 percent to about 70 percent; or about 50 percent to about 70 percent), according to a Transmittance Test that measures the transmittance of 500 nm light through a sample of 6 by 12 inch by approximately 1-2 mil (15.24 by 30.48 cm by 25.4-50.8 μm) clear polyester film, having a transmittance of about 98%.

One component of supersize coats can be a metal salt of a long-chain fatty acid (e.g., a $C_{12}$-$C_{22}$ fatty acid, a $C_{14}$-$C_{18}$ fatty acid, and a $C_{16}$-$C_{20}$ fatty acid). In some examples, the metal salt of a long-chain fatty acid is a stearate salt (e.g., a salt of stearic acid). The conjugate base of stearic acid is $C_{17}H_{35}COO$—, also known as the stearate anion. Useful stearates include, but are not limited to, calcium stearate, zinc stearate, and combinations thereof.

The metal salt of a long-chain fatty acid can be present in an amount of at least 10 percent, at least 50 percent, at least 70 percent, at least 80 percent, or at least 90 percent by weight based on the normalized weight of the supersize coat (i.e., the average weight for a unit surface area of the abrasive article). The metal salt of a long-chain fatty acid can be present in an amount of up to 100 percent, up to 99 percent, up to 98 percent, up to 97 percent, up to 95 percent, up to 90 percent, up to 80 percent, or up to 60 percent by weight (e.g., from about 10 wt. % to about 100 wt. %; about 30 wt. % to about 70 wt. %; about 50 wt. % to about 90 wt. %; or about 50 wt. % to about 100 wt. %) based on the normalized weight of the supersize coat.

Another component of the supersize composition is a polymeric binder, which, in some examples, enables the composition used to form the supersize coat to form a smooth and continuous film over the abrasive layer. In one example, the polymeric binder is a styrene-acrylic polymer binder. In some examples, the styrene-acrylic polymer binder is the ammonium salt of a modified styrene-acrylic polymer, such as, but not limited to, JONCRYL® LMV 7051. The ammonium salt of a styrene-acrylic polymer can have, for example, a weight average molecular weight (Mw) of at least 100,000 g/mol, at least 150,000 g/mol, at least 200,000 g/mol, or at least 250,000 g/mol (e.g., from about 100,000 g/mol to about 2.5×106 g/mol; about 100,000 g/mol to about 500,000 g/mol; or about 250,000 to about 2.5×106 g/mol).

The minimum film-forming temperature, also referred to as MFFT, is the lowest temperature at which a polymer self-coalesces in a semi-dry state to form a continuous polymer film. In the context of the present disclosure, this polymer film can then function as a binder for the remaining solids present in the supersize coat. In some examples, the styrene-acrylic polymer binder (e.g., the ammonium salt of a styrene-acrylic polymer) has an MFFT that is up to 90° C., up to 80° C., up to 70° C., up to 65° C., or up to 60° C.

In some examples, the binder is dried at relatively low temperatures (e.g., at 70° C. or less). The drying temperatures are, in some examples, below the melting temperature of the metal salt of a long-chain fatty acid component of the supersize coat. Use of excessively high temperatures (e.g., temperatures above 80° C.) to dry the supersize coat is undesirable because it can induce brittleness and cracking in the backing, complicate web handling, and increase manufacturing costs. By virtue of its low MFFT, a binder comprised of, e.g., the ammonium salt of a styrene-acrylic polymer allows the supersize coat to achieve better film formation at lower binder levels and at lower temperatures without need for added surfactants such as DOWANOL® DPnP.

The polymeric binder can be present in an amount of at least 0.1 percent, at least 1 percent, or at least 3 percent by weight, based on the normalized weight of the supersize coat. The polymeric binder can be present in an amount of up to 20 percent, up to 12 percent, up to 10 percent, or up to 8 percent by weight, based on the normalized weight of the supersize coat. Advantageously, when the ammonium salt of a modified styrene acrylic copolymer is used as a binder, the haziness normally associated with a stearate coating is substantially reduced.

The supersize coats of the present disclosure optionally contain clay particles dispersed in the supersize coat. The clay particles, when present, can be uniformly mixed with the metal salt of a long chain fatty acid, polymeric binder, and other components of the supersize composition. The clay can bestow unique advantageous properties to the abrasive article, such as improved optical clarity and improved cut performance. The inclusion of clay particles can also enable cut performance to be sustained for longer periods of time relative to supersize coats in which the clay additive is absent.

The clay particles, when present, can be present in an amount of at least 0.01 percent, at least 0.05 percent, at least 0.1 percent, at least 0.15 percent, or at least 0.2 percent by weight based on the normalized weight of the supersize coat. Further, the clay particles can be present in an amount of up to 99 percent, up to 50 percent, up to 25 percent, up to 10 percent, or up to 5 percent by weight based on the normalized weight of the supersize coat.

The clay particles may include particles of any known clay material. Such clay materials include those in the geological classes of the smectites, kaolins, illites, chlorites, serpentines, attapulgites, palygorskites, vermiculites, glauconites, sepiolites, and mixed layer clays. Smectites in particular include montmorillonite (e.g., a sodium montmorillonite or calcium montmorillonite), bentonite, pyrophyllite, hectorite, saponite, sauconite, nontronite, talc, beidellite, and volchonskoite. Specific kaolins include kaolinite, dickite, nacrite, antigorite, anauxite, halloysite, indellite and chrysotile. Illites include bravaisite, muscovite, paragonite, phlogopite and biotite. Chlorites can include, for example, corrensite, penninite, donbassite, sudoite, pennine and clinochlore. Mixed layer clays can include allevardite and vermiculitebiotite. Variants and isomorphic substitutions of these layered clays may also be used.

As an optional additive, abrasive performance may be further enhanced by nanoparticles (i.e., nanoscale particles) interdispersed (e.g., in the clay particles) in the supersize coat. Useful nanoparticles include, for example, nanoparticles of metal oxides, such as zirconia, titania, silica, ceria, alumina, iron oxide, vanadia, zinc oxide, antimony oxide, tin oxide, and alumina-silica. The nanoparticles can have a median particle size of at least 1 nanometer, at least 1.5 nanometers, or at least 2 nanometers. The median particle size can be up to 200 nanometers, up to 150 nanometers, up to 100 nanometers, up to 50 nanometers, or up to 30 nanometers.

Other optional components of the supersize composition include curing agents, surfactants, antifoaming agents, biocides, dispersants and other particulate additives known in the art for use in supersize compositions.

The supersize coat can be formed, in some examples, by providing a supersize composition in which the components are dissolved or otherwise dispersed in a common solvent. In some examples, the solvent is water. After being suitably mixed, the supersize dispersion can be coated onto the abrasive article and dried to provide the finished supersize coat. If a curing agent is present, the supersize composition can be cured (e.g., hardened) either thermally or by exposure to actinic radiation at suitable wavelengths to activate the curing agent.

The coating of the supersize composition onto, e.g., the abrasive layer can be carried out using any known process. In some examples, the supersize composition is applied by spray coating at a constant pressure to achieve a predetermined coating weight. Alternatively, a knife coating method where the coating thickness is controlled by the gap height of the knife coater can be used.

Some embodiments are directed to methods for making the articles (e.g., abrasive articles) described herein. Such methods include providing an attachment layer comprising: a porous backing layer having a first major surface, an opposed second major surface and a first plurality of voids forming a first pattern and extending from the first major surface to the second major surface, and one part of a two-part interconnecting attachment mechanism layer adjacent the second major surface; disposing a curable abrasive layer, having a third major surface and an opposed fourth major surface, on the attachment layer, wherein the first major surface of the attachment layer is adjacent the third major surface of the curable abrasive layer, the curable abrasive layer comprising: a curable composition; abrasive particles at least partially embedded in the curable composition; and a second plurality of voids, absent of the curable composition, extending from the third major surface to the fourth major surface and forming a second pattern, the second pattern being independent of the first pattern; and curing the curable composition to form a cured abrasive layer.

Other methods include providing an attachment layer comprising a porous backing layer having a first major surface, an opposed second major surface and a first plurality of voids forming a first pattern and extending from the first major surface to the second major surface; disposing a curable abrasive layer, having a third major surface and an opposed fourth major surface, on the attachment layer, wherein the first major surface of the attachment layer is adjacent the third major surface of the curable abrasive layer, the curable abrasive layer comprising: a curable composition; abrasive particles at least partially embedded in the curable composition; and a second plurality of voids, absent of the curable composition, extending from the third major surface to the fourth major surface and forming a second pattern, the second pattern being independent of the first pattern; and curing the curable composition to form a cured abrasive layer.

Still other methods include providing an attachment layer comprising: a porous backing layer having a first major surface, an opposed second major surface and a first plurality of voids forming a first pattern and extending from the first major surface to the second major surface and one part of a two-part interconnecting attachment mechanism layer adjacent the second major surface; disposing a curable abrasive layer, having a third major surface and an opposed fourth major surface, on a releasable surface of a releasable layer, the curable abrasive layer comprising: a curable composition; abrasive particles at least partially embedded in the curable composition; and a second plurality of voids, absent of the curable composition, extending from the third major surface to the fourth major surface and forming a second pattern, the second pattern being independent of the first pattern; curing the curable abrasive layer to form a cured abrasive layer on the releasable layer; removing the releasable layer; and adhering the cured abrasive layer to the attachment layer, wherein the first major surface of the attachment layer is adjacent the third major surface of the abrasive layer.

Yet other methods include an attachment layer comprising a porous backing layer having a first major surface, an opposed second major surface and a first plurality of voids forming a first pattern and extending from the first major surface to the second major surface; disposing a curable abrasive layer on a releasable surface of a releasable layer, the curable abrasive layer comprising: a curable composition; abrasive particles at least partially embedded in the curable composition; and a second plurality of voids, absent of the curable composition, extending from the third major surface to the fourth major surface and forming a second pattern, the second pattern being independent of the first pattern; curing the curable abrasive layer to form a cured abrasive layer on the releasable layer, wherein the cured abrasive layer has a third major surface and an opposed fourth major surface; removing the releasable layer; and adhering the cured abrasive layer to the attachment layer, wherein the first major surface of the attachment layer is adjacent the third major surface of the abrasive layer.

Other methods include providing an attachment layer comprising a porous backing layer having a first major surface, an opposed second major surface and a first plurality of voids forming a first pattern and extending from the first major surface to the second major surface and one part of a two-part interconnecting attachment mechanism layer adjacent the second major surface; disposing a curable layer, having a third major surface and an opposed fourth major surface, on a releasable surface of a releasable layer, the curable layer comprising: a curable composition; and a second plurality of voids, absent of the curable composition, extending from the third major surface to the fourth major surface and forming a second pattern, the second pattern being independent of the first pattern; laminating the curable layer to the first major surface of the attachment layer; removing the releasable layer; disposing abrasive particles on the curable layer to form a curable abrasive layer; curing the curable abrasive layer to form a cured abrasive layer, wherein the abrasive particles are at least partially embedded in the cured abrasive layer.

Still other methods include providing an attachment layer comprising a porous backing layer having a first major surface, an opposed second major surface and a first plurality of voids forming a first pattern and extending from the first major surface to the second major surface; disposing a curable layer, having a third major surface and an opposed fourth major surface, on a releasable surface of a releasable layer, the curable layer comprising: a curable composition; and a second plurality of voids, absent of the curable composition, extending from the third major surface to the fourth major surface and forming a second pattern, the second pattern being independent of the first pattern; laminating the curable layer to the first major surface of the attachment layer; removing the releasable layer; disposing abrasive particles on the curable layer to form a curable abrasive layer; curing the curable abrasive layer to form a cured abrasive layer, wherein the abrasive particles are at least partially embedded in the cured abrasive layer.

The various methods described herein can further comprise disposing a size coat on at least one of the curable composition and the cured composition. In some embodiments, a supersize coat can be disposed on the size coat.

In some embodiments, the releasable layer is a release liner. In other embodiments, a porous adhesive layer can be disposed between the first major surface of the attachment layer and the third major surface of the cured abrasive layer. In some examples, the porous adhesive layer allows fluid communication between the attachment layer and the cured abrasive layer.

The term "alkyl" as used herein refers to straight chain and branched alkyl groups having from 1 to 40 carbon atoms ($C_1$-$C_{40}$), 1 to about 20 carbon atoms ($C_1$-$C_{20}$), 1 to 12 carbons ($C_1$-$C_{12}$), 1 to 8 carbon atoms ($C_1$-$C_8$), or, in some embodiments, from 3 to 6 carbon atoms ($C_3$-$C_6$). Examples of straight chain alkyl groups include those with from 1 to 8 carbon atoms such as methyl, ethyl, n-propyl, n-butyl, n-pentyl, n-hexyl, n-heptyl, and n-octyl groups. Examples of branched alkyl groups include, but are not limited to, isopropyl, iso-butyl, sec-butyl, t-butyl, neopentyl, isopentyl, and 2,2-dimethylpropyl groups.

The term "alkoxy" as used herein refers to the group —O-alkyl, wherein "alkyl" is defined herein.

The term "aryl" as used herein refers to cyclic aromatic hydrocarbons that do not contain heteroatoms in the ring. Thus aryl groups include, but are not limited to, phenyl, azulenyl, heptalenyl, biphenyl, indacenyl, fluorenyl, phenanthrenyl, triphenylenyl, pyrenyl, naphthacenyl, chrysenyl, biphenylenyl, anthracenyl, and naphthyl groups. In some embodiments, aryl groups contain about 6 to about 14 carbons ($C_6$-$C_{14}$) or from 6 to 10 carbon atoms ($C_6$-$C_{10}$) in the ring portions of the groups.

The term "about" as used herein can allow for a degree of variability in a value or range, for example, within 10%, within 5%, or within 1% of a stated value or of a stated limit of a range.

Unless specified otherwise herein, the term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Unless specified otherwise herein, the term "substantially no" as used herein refers to a minority of, or mostly no, as in less than about 10%, 5%, 2%, 1%, 0.5%, 0.01%, 0.001%, or less than about 0.0001% or less.

Values expressed in a range format should be interpreted in a flexible manner to include not only the numerical values explicitly recited as the limits of the range, but also to include all the individual numerical values or sub-ranges encompassed within that range as if each numerical value and sub-range were explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. In addition, it is to be understood that the phraseology or terminology employed herein, and not otherwise defined, is for the purpose of description only and not of limitation. Any use of section headings is intended to aid reading of the document and is not to be interpreted as limiting. Further, information that is relevant to a section heading may occur within or outside of that particular section. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

In the methods described herein, the steps can be carried out in any order without departing from the principles of the invention, except when a temporal or operational sequence is explicitly recited. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process. \

Select embodiments of the present disclosure include, but are not limited to, the following:

In a first embodiment, the present disclosure provides an abrasive article comprising:

an attachment layer comprising:

a porous backing layer having a first major surface, an opposed second major surface and a first plurality of voids forming a first pattern and extending from the first major surface to the second major surface; and one part of a two-part interconnecting attachment mechanism layer adjacent the second major surface; and an abrasive layer, having a third major surface and an opposed fourth major surface, comprising:

a cured composition;

abrasive particles at least partially embedded in the cured composition; and a second plurality of voids, absent of the cured composition, extending from the third major surface to the fourth major surface and forming a second pattern, the second pattern being independent of the first pattern, and wherein the first major surface of the attachment layer is adjacent the third major surface of the abrasive layer.

In a second embodiment, the present disclosure provides an abrasive article comprising:

an attachment layer comprising a porous backing layer having a first major surface, an opposed second major surface and a first plurality of voids forming a first pattern and extending from the first major surface to the second major surface; and a continuous abrasive layer, having a third major surface and an opposed fourth major surface, comprising:

a cured composition;

abrasive particles at least partially embedded in the cured composition; and a second plurality of voids, absent of the cured composition, extending from the third major surface to the fourth major surface and forming a second pattern, the second pattern being independent of the first pattern, and wherein the first major surface of the attachment layer is adjacent the third major surface of the abrasive layer.

In a third embodiment, the present disclosure provides an abrasive article according to the second embodiment, wherein the attachment layer includes one part of a two-part interconnecting attachment mechanism integral to the porous backing layer.

In a fourth embodiment, the present disclosure provides an abrasive article according to the second embodiment, wherein the attachment layer includes one part of a two-part interconnecting attachment mechanism layer adjacent the second major surface.

In a fifth embodiment, the present disclosure provides an abrasive article according to any one of the first, third and fourth embodiments, wherein the one part of a two-part interconnecting attachment mechanism includes at least one of a hook and a loop.

In a sixth embodiment, the present disclosure provides an abrasive article according to any one of the first through fifth embodiments, wherein the abrasive layer covers no greater than 98% of the first major surface of the attachment layer.

In a seventh embodiment, the present disclosure provides an abrasive article according to any one of the first through sixth embodiments, wherein the surface topography of the fourth major surface of the abrasive layer is independent of a topography of the first major surface of the attachment layer.

In an eighth embodiment, the present disclosure provides an abrasive article according to any one of the first through seventh embodiments, wherein the cured composition comprises at least one of a cured epoxy-acrylate resin composition and a cured phenolic resin composition.

In a ninth embodiment, the present disclosure provides an abrasive article according to any one of the first through eighth embodiments, wherein the cured composition comprises a polymerized epoxy-acrylate resin composition including at least one a tetrahydrofurfuryl (THF) (meth) acrylate copolymer component; one or more epoxy resins; and one or more hydroxy-functional polyethers.

In a tenth embodiment, the present disclosure provides an abrasive article according to any one of the first through ninth embodiments, wherein the cured composition further comprises one or more photoinitiators.

In an eleventh embodiment, the present disclosure provides an abrasive article according to any one of the first through tenth embodiments, wherein the abrasive particles comprise shaped abrasive particles.

In a twelfth embodiment, the present disclosure provides an abrasive article according to any one of the first through eleventh embodiments, wherein the abrasive article further comprises at least one of a size coat and a supersize coat located adjacent the fourth major surface.

In a thirteenth embodiment, the present disclosure provides an abrasive article according to any one of the first through twelfth embodiments, wherein air flows through the article at a rate of at least 1.0 L/s, such that, when in use, dust can be removed from an abraded surface through the abrasive article.

In a fourteenth embodiment, the present disclosure provides an abrasive article according to any one of the first through thirteenth embodiments further comprising a porous adhesive layer disposed between the first major surface of the attachment layer and the third major surface of the abrasive layer wherein the porous adhesive layer allows fluid communication between the attachment layer and the cured abrasive layer.

In a fifteenth embodiment, the present disclosure provides a method of making an abrasive article comprising:

providing an attachment layer comprising:

a porous backing layer having a first major surface, an opposed second major surface and a first plurality of voids forming a first pattern and extending from the first major surface to the second major surface; and one part of a two-part interconnecting attachment mechanism layer adjacent the second major surface;

disposing a curable abrasive layer, having a third major surface and an opposed fourth major surface, on the attachment layer, wherein the first major surface of the attachment layer is adjacent the third major surface of the curable abrasive layer, the curable abrasive layer comprising:

a curable composition;

abrasive particles at least partially embedded in the curable composition; and a second plurality of voids, absent of the curable composition, extending from the third major surface to the fourth major surface and forming a second pattern, the second pattern being independent of the first pattern; and curing the curable composition to form a cured abrasive layer.

In a sixteenth embodiment, the present disclosure provides a method of making an abrasive article comprising:

providing an attachment layer comprising a porous backing layer having a first major surface, an opposed second major surface and a first plurality of voids forming a first pattern and extending from the first major surface to the second major surface;

disposing a curable abrasive layer, having a third major surface and an opposed fourth major surface, on the attachment layer, wherein the first major surface of the attachment layer is adjacent the third major surface of the curable abrasive layer, the curable abrasive layer comprising:

a curable composition;

abrasive particles at least partially embedded in the curable composition; and a second plurality of voids, absent of the curable composition, extending from the third major surface to the fourth major surface and forming a second pattern, the second pattern being independent of the first pattern; and curing the curable composition to form a cured abrasive layer.

In a seventeenth embodiment, the present disclosure provides a method of making an abrasive article comprising:

providing an attachment layer comprising:

a porous backing layer having a first major surface, an opposed second major surface and a first plurality of voids forming a first pattern and extending from the first major surface to the second major surface; and one part of a two-part interconnecting attachment mechanism layer adjacent the second major surface;

disposing a curable abrasive layer, having a third major surface and an opposed fourth major surface, on a releasable surface of a releasable layer, the curable abrasive layer comprising:

a curable composition;

abrasive particles at least partially embedded in the curable composition; and a second plurality of voids, absent of the curable composition, extending from the third major surface to the fourth major surface and forming a second pattern, the second pattern being independent of the first pattern;

curing the curable abrasive layer to form a cured abrasive layer on the releasable layer; removing the releasable layer; and adhering the cured abrasive layer to the attachment layer, wherein the first major surface of the attachment layer is adjacent the third major surface of the abrasive layer.

In an eighteenth embodiment, the present disclosure provides a method of making an abrasive article comprising:

providing an attachment layer comprising a porous backing layer having a first major surface, an opposed second major surface and a first plurality of voids forming a first pattern and extending from the first major surface to the second major surface;

disposing a curable abrasive layer on a releasable surface of a releasable layer, the curable abrasive layer comprising:

a curable composition;

abrasive particles at least partially embedded in the curable composition; and a second plurality of voids, absent of the curable composition, extending from the third major surface to the fourth major surface and forming a second pattern, the second pattern being independent of the first pattern;

curing the curable abrasive layer to form a cured abrasive layer on the releasable layer, wherein the cured abrasive layer has a third major surface and an opposed fourth major surface;

removing the releasable layer; and adhering the cured abrasive layer to the attachment layer, wherein the first major surface of the attachment layer is adjacent the third major surface of the abrasive layer.

In a nineteenth embodiment, the present disclosure provides a method of making an abrasive article comprising:

providing an attachment layer comprising:

a porous backing layer having a first major surface, an opposed second major surface and a first plurality of voids forming a first pattern and extending from the first major surface to the second major surface; and one part of a two-part interconnecting attachment mechanism layer adjacent the second major surface;

disposing a curable layer, having a third major surface and an opposed fourth major surface, on a releasable surface of a releasable layer, the curable layer comprising: a curable composition; and a second plurality of voids, absent of the curable composition, extending from the third major surface to the fourth major surface and forming a second pattern, the second pattern being independent of the first pattern;

laminating the curable layer to the first major surface of the attachment layer;

removing the releasable layer;

disposing abrasive particles on the curable layer to form a curable abrasive layer; and curing the curable abrasive layer to form a cured abrasive layer, wherein the abrasive particles are at least partially embedded in the cured abrasive layer.

In a twentieth embodiment, the present disclosure provides a method of making an abrasive article comprising:

providing an attachment layer comprising a porous backing layer having a first major surface, an opposed second major surface and a first plurality of voids forming a first pattern and extending from the first major surface to the second major surface;

disposing a curable layer, having a third major surface and an opposed fourth major surface, on a releasable surface of a releasable layer, the curable layer comprising:

a curable composition; and a second plurality of voids, absent of the curable composition, extending from the third major surface to the fourth major surface and forming a second pattern, the second pattern being independent of the first pattern;

laminating the curable layer to the first major surface of the attachment layer; removing the releasable layer;

disposing abrasive particles on the curable layer to form a curable abrasive layer; and curing the curable abrasive layer to form a cured abrasive layer, wherein the abrasive particles are at least partially embedded in the cured abrasive layer.

In a twenty-first embodiment, the present disclosure provides a method of making an abrasive article according to any one of the sixteenth, eighteenth and twentieth embodiments, wherein the attachment layer includes one part of a two-part interconnecting attachment mechanism integral to the porous backing layer.

In a twenty-second embodiment, the present disclosure provides a method of making an abrasive article according to any one of the sixteenth, eighteenth and twentieth embodiments, wherein the attachment layer includes one part of a two-part interconnecting attachment mechanism layer adjacent the second major surface.

In a twenty-third embodiment, the present disclosure provides a method of making an abrasive article according to any one of the fifteenth, seventeenth, nineteenth, twenty-first and twenty-second embodiments, wherein the one part of a two-part interconnecting attachment mechanism includes at least one of a hook and a loop.

In a twenty-fourth embodiment, the present disclosure provides a method of making an abrasive article according to any one of the seventeenth through twenty-third embodiments, wherein the releasable layer is a release liner.

In a twenty-fifth embodiment, the present disclosure provides a method of making an abrasive article according to any one of the fifteenth through twenty-fourth embodiments, wherein the curable composition comprises at least one of a curable epoxy-acrylate resin composition and a phenolic resin composition.

In a twenty-sixth embodiment, the present disclosure provides a method of making an abrasive article according to any one of the fifteenth through twenty-fifth embodiments, wherein the curable composition comprises a polymerizable epoxy-acrylate resin composition including at least one of a tetrahydrofurfuryl (THF) (meth)acrylate copolymer component; one or more epoxy resins; and one or more hydroxy-functional polyethers.

In a twenty-seventh embodiment, the present disclosure provides a method of making an abrasive article according to any one of the fifteenth through twenty-sixth embodiments, wherein the curable composition further comprises one or more photoinitiators.

In a twenty-eighth embodiment, the present disclosure provides a method of making an abrasive article according to any one of the fifteenth through twenty-seventh embodiments, wherein the abrasive particles comprise shaped abrasive particles.

In a twenty-ninth embodiment, the present disclosure provides a method of making an abrasive article according to any one of the fifteenth through twenty-eighth embodiments, wherein the abrasive layer covers no greater than 98% of the first major surface of the attachment layer.

In a thirtieth embodiment, the present disclosure provides a method of making an abrasive article according to any one of the fifteenth through twenty-ninth embodiments, wherein the surface topography of the fourth major surface of the abrasive layer is independent of a topography of the first major surface of the attachment layer.

In a thirty-first embodiment, the present disclosure provides a method of making an abrasive article according to any one of the fifteenth through thirtieth embodiments further comprising a porous adhesive layer disposed between the first major surface of the attachment layer and the third major surface of the cured abrasive layer wherein the porous adhesive layer allows fluid communication between the attachment layer and cured abrasive layer.

In a thirty-second embodiment, the present disclosure provides a method of making an abrasive article according to any one of the fifteenth through thirty-first embodiments, wherein the abrasive article further comprises at least one of a size coat and a supersize coat located adjacent the fourth major surface.

EXAMPLES

The examples described herein are intended solely to be illustrative, rather than predictive, and variations in the manufacturing and testing procedures can yield different results. All quantitative values in the Examples section are understood to be approximate in view of the commonly known tolerances involved in the procedures used. The foregoing detailed description and examples have been given for clarity of understanding only. No unnecessary limitations are to be understood therefrom.

The following abbreviations are used to describe the examples:

° C.: degrees Centigrade cm: centimeter cm/min: centimeters per minute g/eq.: gram equivalent $g/m^2$: grams per square meter in/min: inches per minute Kg: kilogram lb: pound MFFT: minimum film forming temperature min: minute μ-inch: $10^{-6}$ inch mm: millimeter μm: micrometer L/s: Liters/second m/min: meters per minute $mW/cm^2$: milliwatt per square centimeter N: Newton N-mm: Newton-millimeter $N/m^2$: Newton/square meter pbw: parts by weight rpm: revolutions per minute $T_g$: glass transition temperature UV: ultraviolet $W/cm^2$: Watts per square centimeter wt. %: weight percent Unless stated otherwise, all reagents were obtained or are available from chemical vendors such as Sigma-Aldrich Company, St. Louis, Missouri., or may be synthesized by known methods. Unless otherwise reported, all ratios are by dry weight.

Abbreviations for materials and reagents used in the examples are as follows:

CM-5: A fumed silica, obtained under the trade designation "CAB-O-SIL M-5" from Cabot Corporation, Boston, Massachusetts.

CPI-6976: A triarylsulfonium hexafluoroantimonate/propylene carbonate photoinitiator, obtained under the trade designation "CYRACURE CPI 6976" from Dow Chemical Company, Midland, Michigan.

D-1173: A α-Hydroxyketone photoinitiator, obtained under the trade designation "DAROCUR 1173" from BASF Corporation, Florham Park, New Jersey.

I-819: A bis-acyl phosphine photoinitiator, obtained under the trade designation "IRGACURE 819" from BASF Corporation.

MX-10: A sodium-potassium alumina silicate filler, obtained under the trade designation "MINEX 10" from The Cary Company, Addison, Illinois.

P80: An 80 grade aluminum oxide mineral, obtained under the trade name "BFRPL" from Treibacher Industrie AG, Althofen, Austria 80+Mineral Blend: A 90:10 weight percent blend of P80 and 80+ precision shaped grain mineral, obtained under the trade name "Cubitron II", from 3M Company, St. Paul, MN P320: A 320 grade aluminum oxide mineral, obtained under the trade name "BFRPL" from Treibacher Industrie AG, Althofen, Austria SR-351: trimethylol propane triacrylate, available under the trade designation "SR351" from Sartomer USA, LLC, Exton, Pennsylvania.

UVR-6110: 3,4-epoxy cyclohexylmethyl-3,4-epoxy cyclohexylcarboxylate, obtained from Daicel Chemical Industries, Ltd., Tokyo, Japan.

W-985: An acidic polyester surfactant, obtained under the trade designation "BYK W-985" from Byk-Chemie, GmbH, Wesel, Germany.

ARCOL: A polyether polyol, obtained under the trade designation "ARCOL LHT 240" from Bayer Material Science, LLC, Pittsburgh, Pennsylvania.

BA: Butyl acrylate obtained from BASF Corp., Florham Park, New Jersey.

E-1001F: A diglycidylether of bisphenol-A epoxy resin, obtained under the trade designation "EPON 1001F" from Momentive Specialty Chemicals, Inc.

E-1510: Bisphenol-A epoxy resin having an epoxy equivalent weight of 210-220 g/eq, obtained under the trade designation "EPONEX 1510" from Momentive Specialty Chemicals, Inc.

GPTMS: 3-(Glycidoxypropyl) trimethoxysilane, obtained from United Chemical Technologies, Inc., Bristol, Pennsylvania.

I-651: Benzyldimethyl ketal photoinitiator, obtained under the trade designation "IRGACURE 651" from BASF Corporation.

IOTG: Isooctyl thioglycolate obtained from Evans Chemetics, LP, Teaneck, New Jersey.

LVPREN: Ethylene-vinyl acetate copolymer, obtained under the trade designation "LEVAPREN 700HV" from Lanxess Corporation, Pittsburgh, Pennsylvania.

PKHA: Phenoxy resin, obtained under the trade designation "PHENOXY PKHA" from InChem Corporation, Rock Hill, South Carolina.

THFA: Tetrahydrofurfuryl acrylate, V-150, obtained from San Esters Corporation, New York, New York.

Mesh Backing 1: Polyester/Polyamide net backing available under the trade designation "NET MESH" from Sitip S.p.A. —Via Vall' Alta, 13-24030 CENE (BG) IT.

Abrasion Test

Samples were subjected to the following abrasion test. A 6-inch (15.24 cm) diameter abrasive disc was mounted on a 6 inch (15.24 cm) diameter, 25 aperture, backup pad, Part No. "05865," obtained from 3M Company. This assembly was then attached to a dual action sander, disposed over an X-Y table, with a painted test panel (available as part number "59597" from ACT Test Panels LLC, Hillsdale, MI) measuring 18 by 24 inches (45.72 by 60.96 cm) secured to the table. The dual action sander was held at 2.5 degrees and driven electrically at a speed of 5400 rpm. The sander was applied to the painted panel using a downforce of 13 lbs. (5.91 kg). The sander was moved in a side-to-side sweeping motion starting from the lower right corner of the panel and indexing upward after each sweep, such that the entire panel is sanded in 1 minute, in a total of 7 passes of the DA sander. The mass of the panel was measured before and after each cycle to determine the total mass lost in grams for each 1-minute cycle, as well as a cumulative mass loss at the end of 3 cycles. Cut life was measured by dividing the third-pass weight loss by the first-pass weight loss. Each sample was tested in duplicate and the averages of the results are reported in Table 1.

Pressure Drop Test

The pressure drop across each sample was measured at constant air flow rate for Example 3, Comparative A and Comparative B. A 1.2 inch (30.5 mm)×1.4 inch (35.6 mm) sample was used for each measurement. For Comparative A, the sample was taken just outside of the center hole of the abrasive disc. For each pressure drop measurement, the sample was held between two identical plastic frames, exposing an area of 1 inch (25.4 mm) by 1 inch (25.4 mm) in the center of the frames. The frame/sample assembly was inserted into a square duct with inner dimensions of 1 inch (2.54 cm)×1 inch (2.54 cm) such that the plane of the sample is perpendicular to the direction of air flow within the duct. Airflow into the duct was controlled by a regulator such that a constant linear velocity of 3.82 m/s flowed through each sample. Ports were positioned within the duct equidistant from the sample, one before the sample and one after the sample. The ports were connected to a differential pressure gauge and the pressure drop was recorded for each sample. The results from these tests are show in Table 2.

Tensile Force at Break Test

The tensile force required to break an abrasive strip was measured for both Example 3, Comparative Example A, Comparative Example C, Comparative Example D and Comparative Example E. The tensile test was performed on an MTS Alliance RT5 tester, manufactured by MTS Systems Corporation, Cary, North Carolina., USA. For each test, an abrasive strip of 1 inch (25.4 mm wide)×5 inches (127 mm)

was secured in the clamps of the tester such that 2 inches (50.8 mm) of the sample was exposed between the clamps. The sample was stretched at a rate of 50.8 mm/min and the force at break was recorded. The test was repeated for a total of 5 measurements per sample, and the average results are shown in Table 3.

Surface Topography Test

Figure 8:
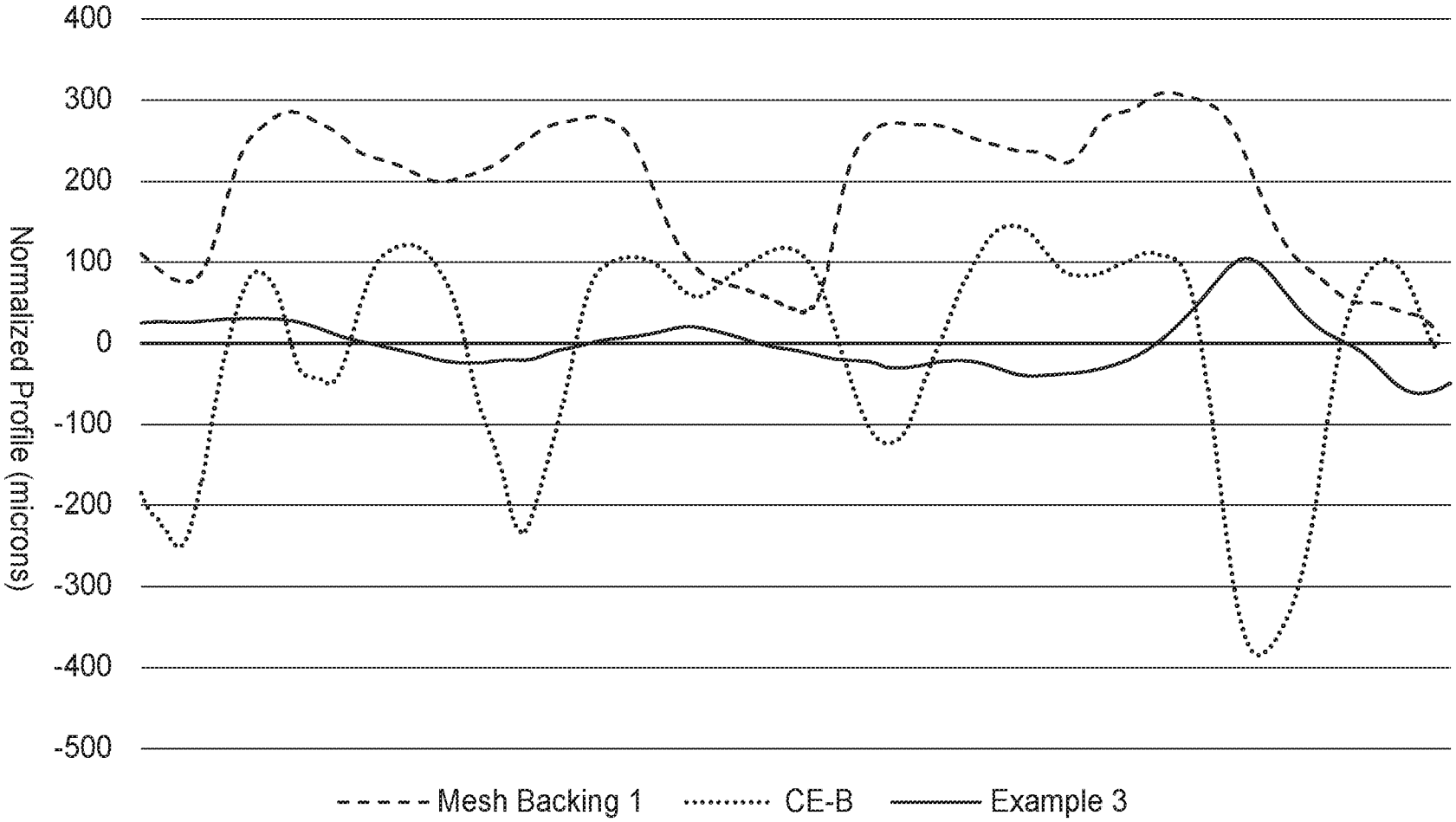
FIG. 8 is a plot of the surface topography of Mesh Backing 1, Example 3 and Comparative Example B of the present disclosure.

The surface topography, i.e. height profile, of Example 3, Comparative Example B and Mesh Backing 1 (used in the fabrication of Example 3) were determined using a 3D Image Stitching function of a Keyence microscope (model VHX-2000 with VH-Z20R lens available from Keyence Company, Osaka, Japan). The "Measure>Profile" function was used across a straight line of abrasive-coated material to collect surface topography data along the line. The data was then normalized and graphed; results are shown in FIG. 8.

Preparing Make Resin 1 (MR1)

387.8 grams UVR-6110, 166.2 grams SR-351 and 6.0 grams W-985 were charged into a 32 oz. (0.95 liter) black plastic container and dispersed for 5 minutes at 70° F. (21.1° C.) using a high-speed mixer. With continuous agitation, 400.0 grams of MX-10 were gradually added over approximately 15 minutes. 30.0 grams CPI-6976 and 10.0 grams I-819 were then added to the resin and dispersed until homogeneous, approximately 5 minutes. Finally, 16 grams CM-5 were gradually added over approximately 15 minutes until homogeneously dispersed.

Preparing Size Resin 1 (SR1)

1008.0 grams UVR-6110 and 432.0 grams SR-351 were charged into a 128 oz. (3.79 liter) black plastic container and dispersed for 5 minutes at 70° F. (21.1° C.) using a high-speed mixer equipped with a Cowles blade. With continuous agitation, 45.0 grams CPI-6976 and 15.0 grams D-1173 were added to the resin and dispersed until homogeneous, approximately 5 minutes.

Preparation of Acrylic Copolymer 1 (AC1)

Acrylic copolymer 1 was prepared by the method of U.S. Pat. No. 5,804,610 (Hamer et al.). A solution was prepared by combining 50 parts by weight (pbw) BA, 50 pbw THFA, 0.2 pbw I-651 and 0.1 pbw IOTG in an amber glass jar and swirling by hand to mix. The solution was divided into 25 gram aliquots within heat sealed compartments of an ethylene vinyl acetate-based film, immersed in a 16° C. water bath, and polymerized using UV light (UVA=4.7 mW/cm$^2$, 8 minutes per side).

Preparation of Hot Melt Resin 1 (HM1)

A hotmelt make resin composition (HM1) was prepared using a BRABENDER mixer (C. W. Brabender Instruments, Inc., Hackensack, New Jersey.) equipped with a 50 gram capacity heated mix head and kneading elements. The mixer was operated at the desired mixing temperature of 120° C. and the kneading elements were operated at 100 rpm. First the AC1 (32 pbw), was added and mixed for several minutes. The E-1001F (19 pbw), LVPREN (10 pbw), and PKHA (10 pbw) were added and mixed until uniformly distributed throughout the mixture. E-1510 (19 pbw), ARCOL (10 pbw), and GPTMS (1 pbw) were premixed and then added slowly until uniformly distributed. The resulting mixture was stirred for several minutes then the photoacid generator (CPI-6976, 0.5 pbw) was added dropwise. The mixture was agitated several minutes and then transferred to an aluminum pan and allowed to cool (care was taken to protect from ambient light exposure).

Example 1

A 31 inch by 23 inch (78.74 by 58.42 cm) stencil of 5 mil (127.0 μm) thick polyester film was made with a zig zag pattern, each zig zag measuring 0.25 inch wide (6.4 mm), spaced 80 mils (2.0 mm) apart, with a wave length of 1 inch (25.4 mm) and maximum amplitude of 1 inch. The pattern was cut into the polyester film using an EAGLE MODEL 500 W CO2 laser, obtained from Preco Laser, Inc., Somerset, Wisconsin. The resulting stencil was mounted taut, with tape, into an aluminum frame measuring 23 inches×31 inches.

The aluminum framed stencil was laid over a 12 inch by 20 inch (30.48 by 50.8 cm) piece of Mesh Backing 1. Approximately 75 grams of MR1, at 70° F. (21.1° C.), was spread over the mesh by hand using a urethane squeegee, and subsequently printed onto the mesh backing without penetrating through to the back of the mesh. The stencil was removed from the backing. Approximately 20 grams of a 80+ Mineral Blend was evenly spread over a 14 inch by 20 inch (35.56 by 50.8 cm) plastic mineral tray to produce a mineral bed. The mineral tray was then inserted into the base of the mineral coater, custom made by 3M Company, Maplewood, MN The resin-coated mesh backing was suspended (with resin exposed) one inch (25.4 mm) above the mineral bed and the mineral electrostatically transferred to the resin surface by applying 20-25 kilovolts DC across the metal plate and resin-coated mesh backing. The sample was cured by passing once through a UV processor, available from American Ultraviolet Company, Murray Hill, New Jersey., using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

SR1 was applied over mineral coated areas of the sheet, so as not to block dust extraction holes, via a kiss coating operation using a roll coater, at 70° F. (21.1° C.) and about 5 m/min., metering SR1 using a Number 90 Mayer Rod. The roll coater, having a steel top roller and a 90 Shore A durometer rubber bottom roller was obtained from Eagle Tool, Inc., Minneapolis, Minnesota. The article was cured by passing once through the UV processor, using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

Example 2

MR1 was applied in a wave pattern onto Mesh Backing 1 using the 2-roll coater disclosed in Example 1. A Number 90 Mayer rod was used to meter MR1 onto the transfer roll, rotating at 5 m/min, and then a notched trowel (Roberts #49737, 3 mm×3 mm×1.5 mm V notch, available from Home Depot, Inc.) was pressed against the rubber transfer roll and manually oscillated from side to side to create the wave pattern in the resin, which was transferred to the mesh backing.

Approximately 20 grams of 80+ Mineral Blend was evenly spread over a 14 inch by 20 inch (35.56 by 50.8 cm) plastic mineral tray to produce a mineral bed. The mineral tray was then inserted into the base of the mineral coater, custom made by 3M Company, Maplewood, MN The resin-coated mesh backing was suspended (with resin exposed) one inch (25.4 mm) above the mineral bed and the mineral electrostatically transferred to the resin surface by applying 20-25 kilovolts DC across the metal plate and resin-coated mesh backing. The sample was cured by passing once through the UV processor, available from American Ultraviolet Company, Murray Hill, New Jersey., using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

SR1 was applied over mineral coated areas of the sheet, so as not to block dust extraction holes, via a kiss coating operation using a roll coater, at 70° F. (21.1° C.) and about 5 m/min., metering the size resin using a Number 90 Mayer Rod. The roll coater, having a steel top roller and a 90 Shore A durometer rubber bottom roller was obtained from Eagle Tool, Inc., Minneapolis, Minnesota. The article was cured by passing once through the UV processor, using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

Example 3

A patterned film of HM1 was made by casting a 3 mil thick film (76 μm) of HM1 at 120° C. onto a patterned tool to make evenly-spaced elliptical openings (2.5 mm×1.6 mm holes with hexagonal packing and an open area of 20%) and positioned onto Mesh Backing 1.

Approximately 5 grams of a P320 mineral was evenly spread over a 14 inch by 20 inch (35.56 by 50.8 cm) plastic mineral tray to produce a mineral bed. The mineral tray was then inserted into the base of the mineral coater, custom made by 3M Company, Maplewood, MN The resin-coated mesh backing was suspended (with resin exposed) one inch (25.4 mm) above the mineral bed and the mineral electrostatically transferred to the resin surface by applying 20-25 kilovolts DC across the metal plate and resin-coated mesh backing. The sample was cured by passing once through the UV processor, available from American Ultraviolet Company, Murray Hill, New Jersey., using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

SR1 was applied over mineral coated areas of the sheet, so as not to block dust extraction holes, via a kiss coating operation using a roll coater, at 70° F. (21.1° C.) and about 5 m/min., metering the size resin using a Number 90 Mayer Rod. The roll coater, having a steel top roller and a 90 Shore A durometer rubber bottom roller was obtained from Eagle Tool, Inc., Minneapolis, Minnesota. The article was cured by passing once through the UV processor, using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

Comparative Example A (CE-A)

6-inch (15.24 cm) loop-backed abrasive discs, available under the trade designation "P320 334U," from 3M Company, St. Paul, MN Comparative Example B (CE-B)

6-inch (15.24 cm) loop-backed abrasive discs, available under the trade designation "P320 Abranet," from KWH Mirka, Finland.

Comparative Example C (CE-C)

6-inch (15.24 cm) loop-backed abrasive discs, available under the trade designation "P320 Norton Multi-Air Cyclonic", from San-Gobain Abrasives, Inc., Worcester, MA Comparative Example D (CE-D)

6-inch (15.24 cm) loop-backed abrasive discs, available under the trade designation "P320 SUNMIGHT FILM 9-HOLE", from Sunmight USA Corp., La Mirada, CA Comparative Example E (CE-E)

6-inch (15.24 cm) loop-backed abrasive discs, available under the trade designation "P320 SIAFAST ABRASIVE", from Sia Abrasives USA, Lincolnton, NC Using the Abrasion Test, Example 3, Comparative Example A and Comparative Example B were evaluated. Results are shown in Table 1.

TABLE 1

| Sample | Cut 1 60 sec (g) | Cut 2 60 sec (g) | Cut 3 60 sec (g) | Total cut (g) | Cut Life |
|---|---|---|---|---|---|
| CE-A | 4.02 | 2.77 | 2.03 | 8.82 | 0.505 |
| Example 3 | 2.96 | 2.10 | 1.43 | 6.49 | 0.481 |
| CE-B | 2.28 | 1.09 | 0.56 | 3.93 | 0.246 |

Using the Pressure Drop Test, Example 3, Comparative Example A and Comparative Example B were evaluated. Results are shown in Table 2.

TABLE 2

| | Sample | | |
|---|---|---|---|
| | Example 3 | CE-A | CE-B |
| Pressure Drop (N/m$^2$) | 96 | 386 | 63 |

Using the Tensile Force at Break Test, Example 3, Comparative Example A, Comparative Example C, Comparative Example D and Comparative Example E were evaluated. Results are shown in Table 3.

TABLE 3

| | Tensile Force at Break (Newtons) | Comments |
|---|---|---|
| Example 3 | 319.1 +/− 22.3 | |
| CE-A | 127.3 +/− 14.9 | |
| CE-C | 90.5 +/− 10.4 | The test strips did not include the center hole. |
| CE-D | 116.8 +/− 12.5 | The test strips included the center hole. |
| CE-E | 124.2 +/− 11.6 | |

It will be apparent to those skilled in the art that the specific structures, features, details, configurations, etc., that are disclosed herein are simply examples that can be modified and/or combined in numerous embodiments. All such variations and combinations are contemplated by the inventor as being within the bounds of this disclosure. Thus, the scope of the disclosure should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control. Furthermore, all publications, patents, and patent documents referred to in this document are incorporated by reference herein in their entirety, as though they were fully set forth herein.

What is claimed is:

1. An abrasive article comprising:

an attachment layer comprising:

a porous backing layer having a first major surface, an opposed second major surface and a first plurality of voids forming a first regular pattern and extending from the first major surface to the second major surface; and an abrasive layer, having a third major surface and an opposed fourth major surface, the abrasive layer comprising:

a cured composition;

abrasive particles at least partially embedded in the cured composition; and a second plurality of voids, absent of the cured composition, extending from the third major surface to the fourth major surface and forming a second regular pattern, the second pattern being independent of the first pattern, and wherein the third major surface of the cured composition of the abrasive layer is adhered adjacent to the first major surface of the attachment layer.

2. The abrasive article of claim 1, wherein the attachment layer includes one part of a two-part interconnecting attachment mechanism integral to the porous backing layer.

3. The abrasive article of claim 1, wherein the attachment layer includes one part of a two-part interconnecting attachment mechanism layer adjacent the second major surface.

4. The abrasive article of claim 2, wherein the one part of a two-part interconnecting attachment mechanism includes at least one of a hook and a loop.

5. The abrasive article of claim 1, wherein the abrasive layer covers no greater than 98% of the first major surface of the attachment layer.

6. The abrasive article of claim 1, wherein the surface topography of the fourth major surface of the abrasive layer is independent of a topography of the first major surface of the attachment layer.

7. The abrasive article of claim 1, wherein the cured composition comprises at least one of a cured epoxy-acrylate resin composition and a cured phenolic resin composition.

8. An abrasive article comprising:

an attachment layer comprising:

a porous backing layer having a first major surface, an opposed second major surface and a first plurality of voids forming a first pattern and extending from the first major surface to the second major surface; and an abrasive layer, having a third major surface and an opposed fourth major surface, the abrasive layer consisting essentially of:

a cured composition, wherein the cured composition comprises a polymerized epoxy-acrylate resin composition including at least one a tetrahydrofurfuryl (THF) (meth)acrylate copolymer component; one or more epoxy resins; and one or more hydroxy-functional polyethers;

abrasive particles at least partially embedded in the cured composition; and a second plurality of voids, absent of the cured composition, extending from the third major surface to the fourth major surface and forming a second regular pattern, the second pattern being independent of the first pattern, and wherein the cured composition of the abrasive layer is adhered to the attachment layer such that the first major surface of the attachment layer is adjacent the third major surface of the abrasive layer.

9. The abrasive article of claim 1, wherein the cured composition further comprises one or more photoinitiators.

10. The abrasive article of claim 1, wherein the abrasive particles comprise shaped abrasive particles.

11. The abrasive article of claim 1, wherein the abrasive article further comprises at least one of a size coat and a supersize coat located adjacent the fourth major surface.

12. The abrasive article of claim 1, wherein air flows through the article at a rate of at least 1.0 L/s, such that, when in use, dust can be removed from an abraded surface through the abrasive article.

13. An abrasive article comprising:

an attachment layer comprising:

a porous backing layer having a first major surface, an opposed second major surface and a first plurality of voids forming a first pattern and extending from the first major surface to the second major surface; and an abrasive layer, having a third major surface and an opposed fourth major surface, the abrasive layer comprising:

a cured composition;

abrasive particles at least partially embedded in the cured composition; and a second plurality of voids, absent of the cured composition, extending from the third major surface to the fourth major surface and forming a second pattern, the second pattern being independent of the first pattern, and wherein the third major surface of the cured composition of the abrasive layer is adhered adjacent to the first major surface of the attachment layer, and wherein the majority of each of the second plurality of voids is generally larger than the majority of each of the first plurality of voids.

* * * * *